US006684040B2

(12) United States Patent
Yokoi et al.

(10) Patent No.: US 6,684,040 B2
(45) Date of Patent: Jan. 27, 2004

(54) DEVELOPING DEVICE, PROCESS CARTRIDGE, ELECTROPHOTOGRAPHIC IMAGE FORMING APPARATUS, AND DEVELOPER CONTAINER AND METHOD OF ASSEMBLING THE DEVELOPER CONTAINER

(75) Inventors: Akiyoshi Yokoi, Shizuoka (JP); Kazushi Watanabe, Shizuoka (JP); Toru Oguma, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/094,605

(22) Filed: Mar. 12, 2002

(65) Prior Publication Data

US 2003/0161657 A1 Aug. 28, 2003

(30) Foreign Application Priority Data

Feb. 27, 2002 (JP) ..... 2002-050657

(51) Int. Cl.[7] ..... G03G 15/00; G03G 21/18

(52) U.S. Cl. ..... 399/119; 399/113

(58) Field of Search ..... 399/111, 113, 399/119, 120, 110, 109

(56) References Cited

U.S. PATENT DOCUMENTS

| | | | | |
|---|---|---|---|---|
| 4,757,344 | A | 7/1988 | Idenawa et al. | 399/113 |
| 5,294,960 | A | 3/1994 | Nomura et al. | 399/113 |
| 5,331,372 | A | 7/1994 | Tsuda et al. | 399/114 |
| 5,404,198 | A | 4/1995 | Noda et al. | 399/107 |
| 5,510,878 | A | 4/1996 | Noda et al. | 399/111 |
| 5,561,504 | A | 10/1996 | Watanabe et al. | 399/111 |
| 5,623,328 | A | 4/1997 | Tsuda et al. | 399/111 |
| 5,659,847 | A | 8/1997 | Tsuda et al. | 399/113 |
| 5,669,042 | A | 9/1997 | Kobayashi et al. | 399/111 |
| 5,790,923 | A | 8/1998 | Oguma et al. | 399/106 |
| 5,794,101 | A | 8/1998 | Watanabe et al. | 399/103 |
| 5,809,374 | A | 9/1998 | Tsuda et al. | 399/111 |
| 5,828,928 | A | 10/1998 | Sasago et al. | 399/111 |
| 5,878,304 | A | 3/1999 | Watanabe et al. | 399/92 |
| 5,903,803 | A | 5/1999 | Kawai et al. | 399/116 |
| 5,937,242 | A | 8/1999 | Yokoyama et al. | 399/114 |
| 5,940,658 | A | 8/1999 | Yokoi et al. | 399/119 |
| 5,966,568 | A | 10/1999 | Numagami et al. | 399/111 |
| 6,006,058 | A | 12/1999 | Watanabe et al. | 399/167 |
| 6,016,413 | A | 1/2000 | Yokoyama et al. | 399/113 |
| 6,029,032 | A | 2/2000 | Watanabe et al. | 399/111 |
| 6,070,028 | A | 5/2000 | Odagawa et al. | 399/104 |
| 6,097,909 | A | 8/2000 | Watanabe et al. | 399/111 |
| 6,101,354 | A | 8/2000 | Nakagawa et al. | 399/225 |
| 6,118,960 | A | 9/2000 | Nakagawa et al. | 399/111 |
| 6,128,454 | A | 10/2000 | Kawai et al. | 399/116 |
| 6,141,513 | A | * 10/2000 | Nishiuwatoko et al. | 399/113 X |
| 6,144,398 | A | 11/2000 | Yokoyama et al. | 347/263 |
| 6,163,665 | A | 12/2000 | Watanabe et al. | 399/111 |
| 6,169,866 | B1 | 1/2001 | Watanabe et al. | 399/111 |

(List continued on next page.)

FOREIGN PATENT DOCUMENTS

| | | |
|---|---|---|
| EP | 0 381 401 | 8/1990 |
| EP | 1 117 015 A2 | 7/2001 |

*Primary Examiner*—Sophia S. Chen
(74) *Attorney, Agent, or Firm*—Fitzpatrick, Cella, Harper & Scinto

(57) ABSTRACT

A developer container with an increased capacity that does not enlarge a process cartridge or an apparatus main body used therewith includes flanges on an opposite surface of a developing frame respectively contacting flanges formed on the upper part and the lower part on a wall surface of a container frame, on which a developer feeding opening is formed. To form the developer, container the flanges are welded at their connection portions by ultrasonic welding. Then, a flange of a lid frame is connected to a flange of the container frame by ultrasonic waves, thereby forming a developer container, in which the container frame is connected with the developing frame with the developer feeding opening being put between the frames.

32 Claims, 16 Drawing Sheets

U.S. PATENT DOCUMENTS 6,175,706 B1 1/2001 Watanabe et al. ..... 399/167
6,226,478 B1 5/2001 Watanabe et al. ..... 399/117
6,236,821 B1 5/2001 Yokoyama et al. ..... 399/113
6,240,266 B1 5/2001 Watanabe et al. ..... 399/117
6,246,849 B1 6/2001 Yokoyama et al. ..... 399/117
6,253,036 B1 6/2001 Karakama et al. ..... 399/27
6,266,500 B1 7/2001 Numagami et al. ..... 399/104
6,272,299 B1 8/2001 Numagami et al. ..... 399/111
6,324,363 B1 11/2001 Watanabe et al. ..... 399/111
6,377,759 B1 4/2002 Abe et al. ..... 399/27
6,377,765 B1 * 4/2002 Shishido et al. ..... 399/113

* cited by examiner

DEVELOPING DEVICE, PROCESS CARTRIDGE, ELECTROPHOTOGRAPHIC IMAGE FORMING APPARATUS, AND DEVELOPER CONTAINER AND METHOD OF ASSEMBLING THE DEVELOPER CONTAINER

BACKGROUND OF THE INVENTION

1. Field of the Invention

The present invention relates to a process cartridge being detachably mountable to the main body of an electrophotographic image forming apparatus, the electrophotographic image forming apparatus, a developing device, a developer container, and a method of assembling the developer container.

Hereupon, the electrophotographic image forming apparatus is an apparatus for forming an image on a recording medium using an electrophotographic image forming process. The electrophotographic image forming apparatus includes, for example, an electrophotographic copying machine, an electrophotographic printer (e.g. a laser beam printer, a light emitting diode (LED) printer, and the like), a facsimile machine, a word processor and the like.

Moreover, the process cartridge is a cartridge, into which an electrophotographic photosensitive member and at least developing means are integrally incorporated, and which is detachably mountable to the main body of an electrophotographic image forming apparatus. Incidentally, the process cartridge may include at least one of charging means for charging an electrophotographic photosensitive member and cleaning means for cleaning the electrophotographic photosensitive member besides the developing means.

2. Description of Related Art

Conventionally, an electrophotographic image forming apparatus has adopted a process cartridge system, in which an electrophotographic photosensitive member and process means acting on the electrophotographic photosensitive member are integrally formed into a cartridge detachably mountable to the main body of the electrophotographic image forming apparatus. Because, according to the process cartridge system, a user himself or herself can perform the maintenance of the apparatus without relying on a service person, the operability of the electrophotographic image forming apparatus could remarkably be improved. Accordingly, the process cartridge system is widely adopted in the electrophotographic image forming apparatus.

As shown in FIG. 15, a conventional process cartridge B includes a developing device unit 119 integrally formed by welding a developer container 114 and a developing frame 113 together. The developer container 114 contains developer and an agitating member 115 disposed in the developer container 114. The developing frame 113 holds developing means such as a developing blade 112 and a developing roller 111 as a developing member. The process cartridge B also includes a photosensitive member unit 120 composed of a photosensitive drum 109, cleaning means 117 including a cleaning blade 117*a* and a removed developer reservoir 117*b*, a charging roller 110, and the like, all being attached to a drum frame 118. The process cartridge B is made to be a cartridge by the combination of the developing device unit 119 and the photosensitive member unit 120 in the state of being swingable or integrated.

In such a process cartridge B, the developing device, or the developing device unit 119, is ordinarily composed as two-divided sections of the developing frame 113 supporting the developing roller 111 and the developing blade 112 as the developing members and the developer container 114 for containing developer therein. Moreover, ultrasonic-welding a container frame 122 and a lid frame 123 together at a welding plane U forms the developer container 114 in the shape of a container. After that, flanges 122*a* and 122*b* formed along a developer feeding opening of the developer container 114 (the container frame 122) and welding ribs 113*a* and 113*b* formed on the developing frame 113 are abutted against each other, and the flanges 122*a* and 122*b* and the welding ribs 113*a* and 113*b* are connected to each other by the ultrasonic welding at connection portions X and Y.

The ultrasonic welding of the developer container 114 and the developing frame 113 of the aforesaid conventional process cartridge B is performed by the following method as shown in FIG. 16. That is, the flanges 122*a* and 122*b* provided on the developer container 114 are supported on their under face by receiving jigs 170*a* and 170*b*, respectively. Then, the developing frame 113 is placed on the flanges 122*a* and 122*b*, and the developing frame 113 and the flanges 122*a* and 122*b* are welded by ultrasonic waves at the connection portions X and Y by the use of welding horns 171*a* and 171*b*, respectively, from the upper side of the developing frame 113. That is, the developing frame 113 and the developer container 114 are put between the receiving jigs 170*a* and 170*b* and the welding horns 171*a* and 171*b*, respectively, and the developing frame 113 and the developer container 114 are welded and fixed at the connection portions X and Y. Consequently, the developing frame 113 and the developer container 114 need the flanges.

As such, in the developing frame 113 and the developer container 114, the welding plane U is disposed between the two connection portions X and Y using the flanges. Therefore, spaces are required between the welding plane U and the two connection portions X and Y. These spaces are dead spaces in which developer cannot be contained. Consequently, the conventional process cartridge B has a problem that the process cartridge B and the main body of the electrophotographic image forming apparatus become larger than necessary if the capacity of the developer container 14 in which developer can be contained is enlarged.

The present invention is a further development of the related art.

SUMMARY OF THE INVENTION

An object of the present invention is to provide a developer container including a developer containing portion being improved in the efficiency of the developer containing capacity of the developer containing portion, a developing device using the developer container, a process cartridge using the developer container, a method of assembling the developer container, and an electrophotographic image forming apparatus.

Another object of the present invention is to provide a developer container including a developer containing portion, the developer containing capacity of which is increased, a developing device using the developer container, a process cartridge using the developer container, a method of assembling the developer container, and an electrophotographic image forming apparatus.

A further object of the present invention is to provide a developer container capable of connecting its developer containing portion with its developing frame without forming a flange in at least one portion, a developing device using the developer container, a process cartridge using the developer container, a method of assembling the developer container, and an electrophotographic image forming apparatus.

A still further object of the present invention is to provide a developer container capable of increasing its capacity not only without increasing the size of a developing device or a process cartridge but also without increasing the size of an electrophotographic image forming apparatus, the developing device using the developer container, the process cartridge using the developer container, a method of assembling the developer container, and the electrophotographic image forming apparatus.

A still further object of the present invention is to provide a developer container formed by connecting a developer containing portion and a developing frame on the side opposite to the developer containing side of the developer containing portion when the developer containing portion and the developing frame are connected together, a developing device using the developer container, a process cartridge using the developer container, a method of assembling the developer container, and an electrophotographic image forming apparatus.

According to the present invention, it becomes possible to increase the capacity of a developer container.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Figure 1:
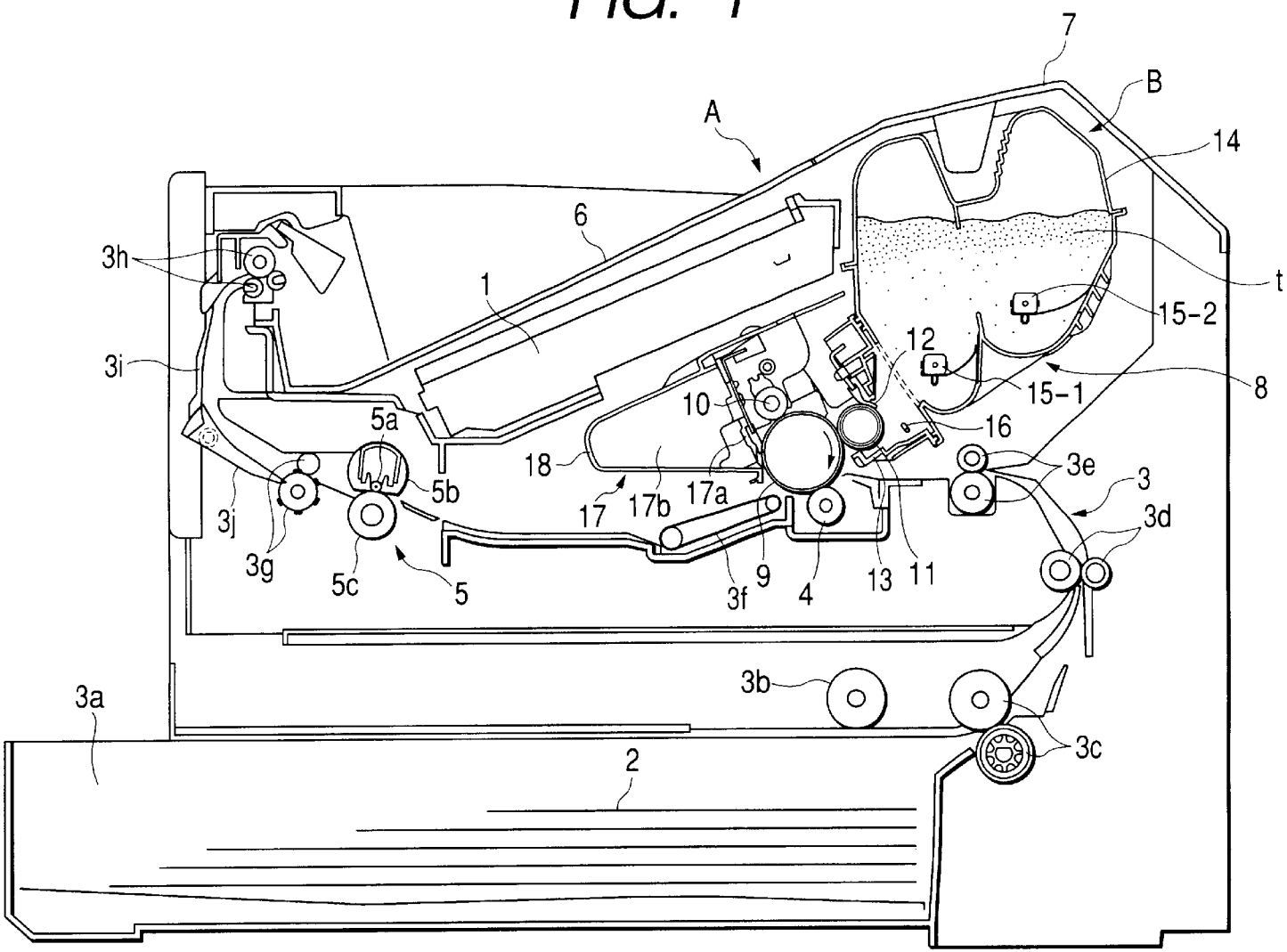
FIG. 1 is a schematic view showing the entire configuration an electrophotographic image forming apparatus according to an embodiment of the present invention.

Hereinafter, preferred embodiments of a developer container, a method of assembling the developer container, a developing device, a process cartridge and an electrophotographic image forming apparatus according to the present invention will be described with reference to the accompanying drawings.

At first, an electrophotographic image forming apparatus detachably mounting a developing device or a process cartridge according to the present invention will be described with reference to FIGS. 1 to 10. Incidentally, a laser beam printer of an electrophotographic type is especially exemplified in the present embodiment.

An electrophotographic image forming apparatus (hereinafter simply referred to as an "image forming apparatus") A includes a drum-shaped electrophotographic photosensitive member (hereinafter simply referred to as a "photosensitive drum") 9. The photosensitive drum 9 is charged by a charging roller 10 as charging means, and then a laser beam corresponding to image information irradiates the photosensitive drum 9 from optical means 1 including a laser diode, a polygon mirror, a lens, a reflection mirror, and so on. Thereby, an electrostatic latent image corresponding to the image information is formed on the photosensitive drum 9. A developing device develops the electrostatic latent image with developer.

The developing device includes a developing roller 11 incorporating a magnet roller in the inside thereof, and a developing blade 12 as a developer amount regulating member for giving triboelectification charges to the developer on the surface of the developing roller 11 and for forming a developer layer having a predetermined thickness. A developing frame 13 holds the developing roller 11 and the developing blade 12. As described later, the developing frame 13 is welded to a developer container 14 for containing developer, and is made into a unitary body with the developer container 14 to constitute a developing device unit 19.

The developer container 14 is therein provided with agitating members 15-1 and 15-2 for agitating and feeding the developer to the developing frame 13. The developer in the developer container 14 is fed to the developing roller 11 in the developing frame 13 by the rotations of the agitating members 15-1 and 15-2. Moreover, the developing frame 13 is therein provided with a developer agitating member 16 in the vicinity of the developing roller 11. The agitating member 16 circulates the developer in the developing frame 13.

The developer t contained in the developer container 14 is fed to the developing frame 13 by the rotations of the agitating members 15-1 and 15-2 in the configuration described above. Then, the developer is agitated by the agitating member 16 in the developing frame 13 while being fed to the developing roller 11. And, the developer adheres to the surface of the developing roller 11 incorporating the magnet roller therein, and the developer is carried by the rotation of the developing roller 11. Then, the developer is given triboelectification charges by the developing blade 12, and a developer layer having a predetermined thickness is formed on the developing roller 11 and carried to a developing area of the photosensitive drum 9. The developer fed to the developing area is transferred to the electrostatic latent image on the photosensitive drum 9 to develop the electrostatic latent image. Incidentally, the developing roller 11 is connected with a developing bias circuit, which ordinarily applies a developing bias voltage composed of an alternative-current voltage superimposed on a direct-current voltage to the developing roller 11.

On the other hand, a recording medium 2 set in a cassette 3*a* is transported to a transferring position by a pickup roller 3*b* and pairs of transporting rollers 3*c*, 3*d* and 3*e* in synchronism with the formation of the developer image described above. At the transferring position, a transferring roller 4 as transferring means is disposed. By the application of a voltage to the transferring roller 4, the developer image on the photosensitive drum 9 is transferred to the recording medium 2.

The recording medium 2 on which the developer image has been transferred is transported to fixing means 5 through a transportation guide 3*f*. The fixing means 5 is provided with a driving roller 5*c* and a fixing roller 5*b* incorporating a heater 5*a* therein, and the fixing means 5 fixes the transferred developer image on the recording medium 2 by applying heat and pressure to the passing recording medium 2. After that, the recording medium 2 is delivered to a delivery tray 6 by pairs of delivery rollers 3*g* and 3*h* through a surface reverse path 3*i*. The delivery tray 6 is formed at the top surface of the image forming apparatus A. Incidentally, the recording medium 2 can also be delivered without passing through the surface reverse path 3*i* by the operation of a swingable flapper 3*j*. The pickup roller 3*b*, the pairs of the transporting rollers 3*c*, 3*d* and 3*e*, the transportation guide 3*f* and the pairs of the delivery rollers 3*g* and 3*h*, and so on constitute the transporting means 3 for the recording medium 2.

After the developer image has been transferred to the recording medium 2 by the transferring roller 4, the developer remaining on the photosensitive drum 9 is removed by cleaning means 17 so that the photosensitive drum 9 is ready for the next image forming process. The cleaning means 17 scrapes off the developer remaining on the photosensitive drum 9 with an elastic cleaning blade 17*a* provided in contact with the photosensitive drum 9, and the cleaning means 17 collects the removed developer to a removed developer reservoir 17*b*.

A process cartridge B detachably mountable to the image forming apparatus A configured as described above is configured as shown in FIG. 2 and FIG. 3 in detail. That is, the process cartridge (hereinafter simply referred to as a "cartridge") B includes the developing device unit 19 composed of the developer container 14 and the developing frame 13, which are formed into a unitary body by welding or the like. The developing frame 13 holds a developing device having the developing roller 11, the developing blade 12 and the like. The cartridge B also includes a photosensitive member unit 20 composed of a drum frame 18, to which the photosensitive drum 9, the cleaning means 17 such as the cleaning blade 17*a*, the charging roller 10, and so on are attached. The developing device unit 19 and the photosensitive member unit 20 are flanked by a side cover (L) 37 on the left side end and a side cover (R) 38 on the right side end and connected integrally into a cartridge as shown in FIG. 3.

When the cartridge B is to be mounted to the apparatus main body of the image forming apparatus A, first a cartridge door 7 (see FIG. 1) provided on the apparatus main body of the image forming apparatus A is opened, and the cartridge B is detachably mounted on a cartridge mounting portion 8 provided in the apparatus main body. In the cartridge mounting portion 8, guide means (not shown) for guiding and leading guided means (not shown) provided on the outside surfaces of the opposed ends of the cartridge B, and positioning means (not shown) for positioning the cartridge B. Consequently, the cartridge door 7 (see FIG. 1) of the apparatus main body is opened and the cartridge B is inserted into the apparatus main body and moved along the guide means formed on inner surfaces of both the side walls of the apparatus main body. And then, the cartridge B is positioned by the positioning means of the cartridge mounting portion 8.

Next, the construction of the developer container 14 of the present embodiment will be described further in detail with reference to FIGS. 2, 3, 4, 5, 6A, 6B and 6C.

The developer container 14 is composed of a container frame 22 and a lid frame 23. The developer container 14 includes two containing portions 14*a* and 14*b*. At a position in which the bottom surfaces of the containing portions 14*a* and 14*b* meet with each other, a bottom partition portion 14*c* for regulating the height at which developer is drawn from the containing portion 14*b* is formed. The feeding of the developer from the containing portion 14*b* to the containing portion 14*a* is performed through an opening portion 14*d* formed above the partition portion 14*c*. Then, the agitating members 15-1 and 15-2 are disposed in the containing portions 14*a* and 14*b*, respectively. The agitation member 15-1 in the containing portion 14*a* is disposed at a relatively lower position than the agitating member 15-2. Thereby, the developer passed through the opening portion 14d can smoothly be carried using the falling of the developer caused by the self-weight of the developer.

Figure 2:
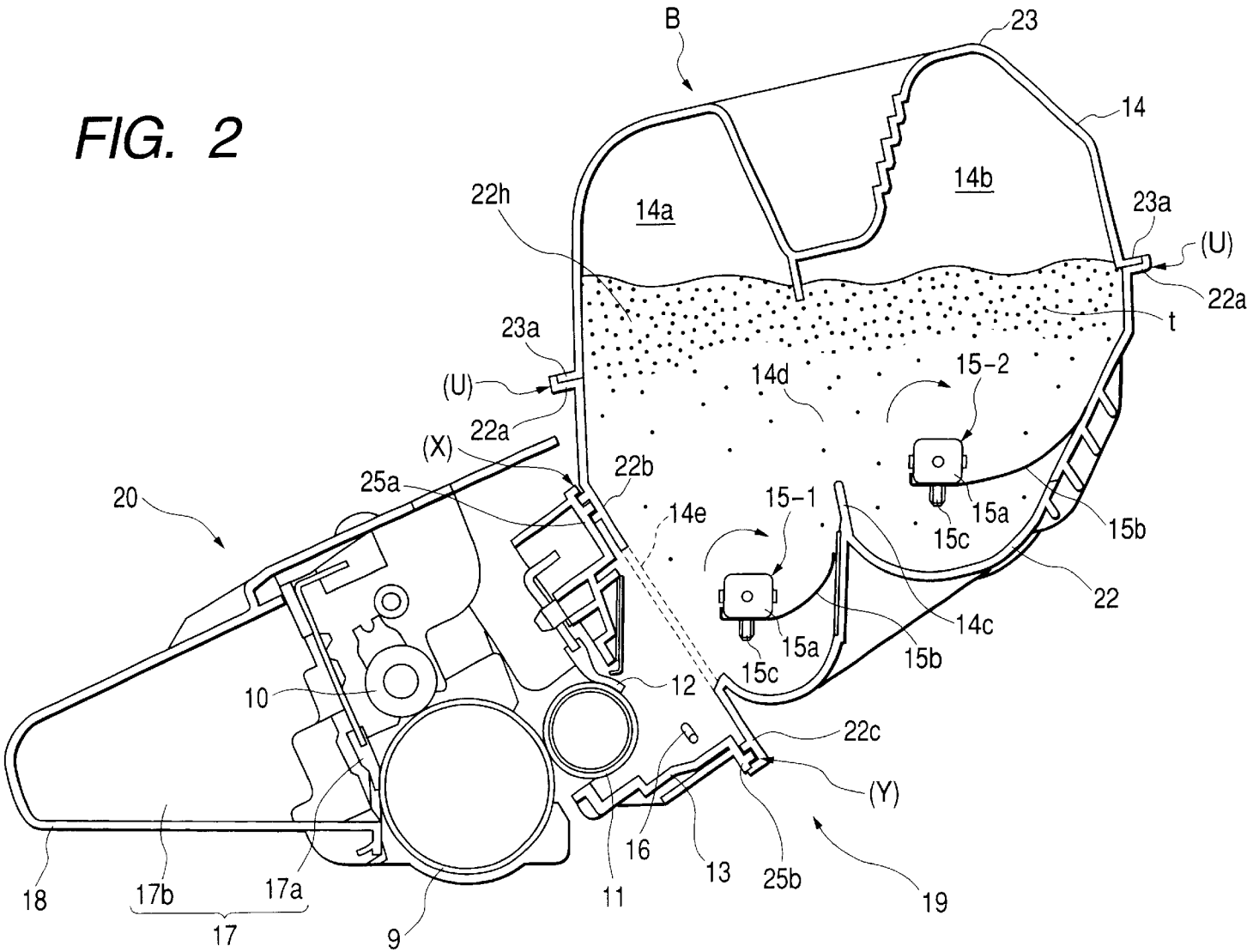
FIG. 2 is a sectional schematic view showing an embodiment of a process cartridge of the present invention.
Figure 3:
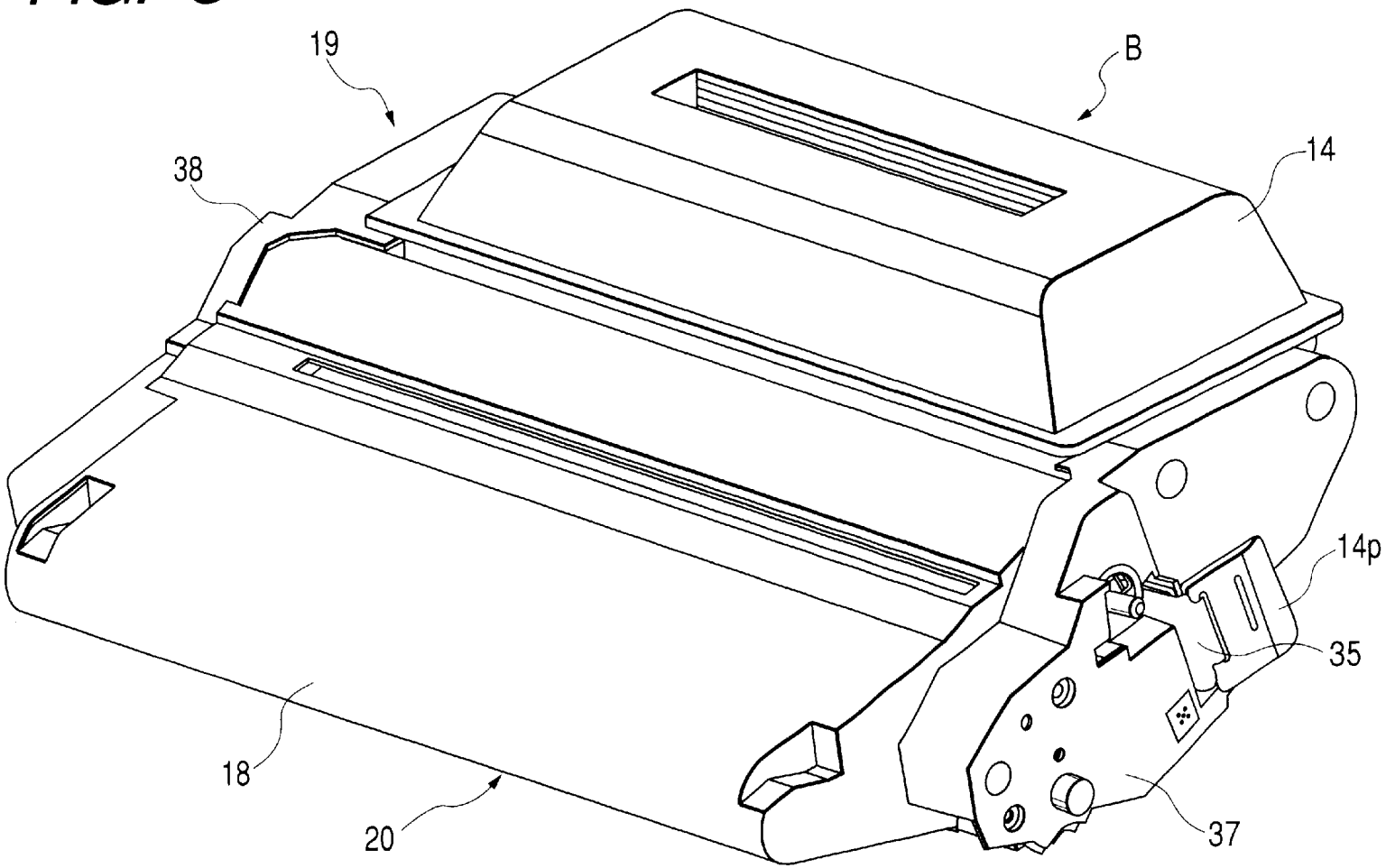
FIG. 3 is a perspective view of the external appearance of the process cartridge of the embodiment of the invention.
Figure 4:
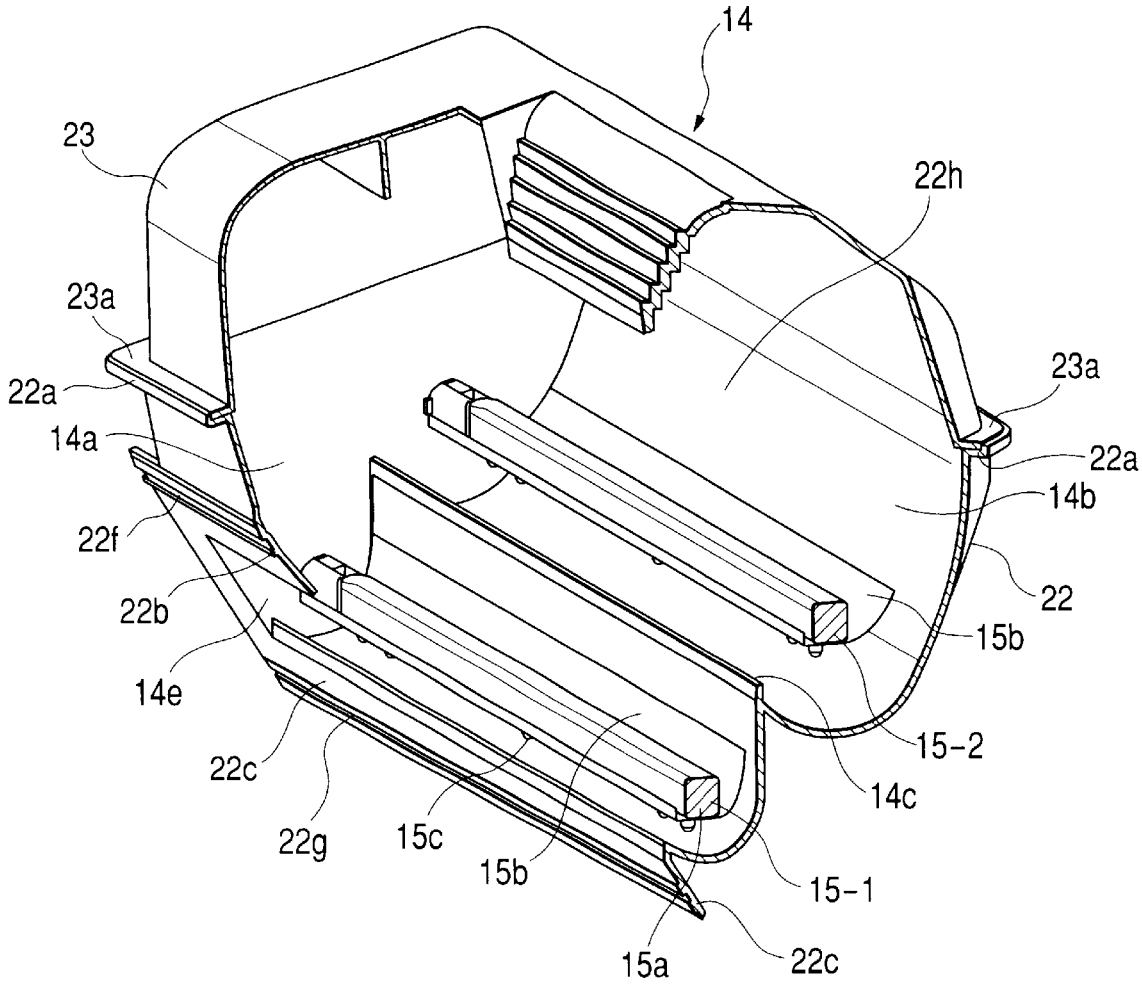
FIG. 4 is a partially broken away perspective view of a developer container of the process cartridge according to the embodiment of the invention.

As shown in FIG. 2 and FIG. 4, each of the agitating members 15-1 and 15-2 is composed of a rotating bar member 15*a*, an elastic sheet 15*b* made from poly phenylene sulfide (PPS), and a pressing member 15*c*. The elastic sheet 15*b* is fixed to the rotating bar member 15*a* by means of screwing, gluing, welding, caulking with heat, or the like.

The agitating member 15-2 in the containing portion 14*b* rotates in the direction indicated by an arrow in FIG. 2 to agitate the developer in the containing portion 14*b* while feeding the developer into the containing portion 14*a* through the opening portion 14*d*. And, the agitating member 15-1 in the containing portion 14*a* rotates in the direction indicated by the arrow in FIG. 2 to agitate the developer in the containing portion 14*a* while feeding the developer into the developing frame 13 through the developer feeding opening 14*e*.

Figure 5:
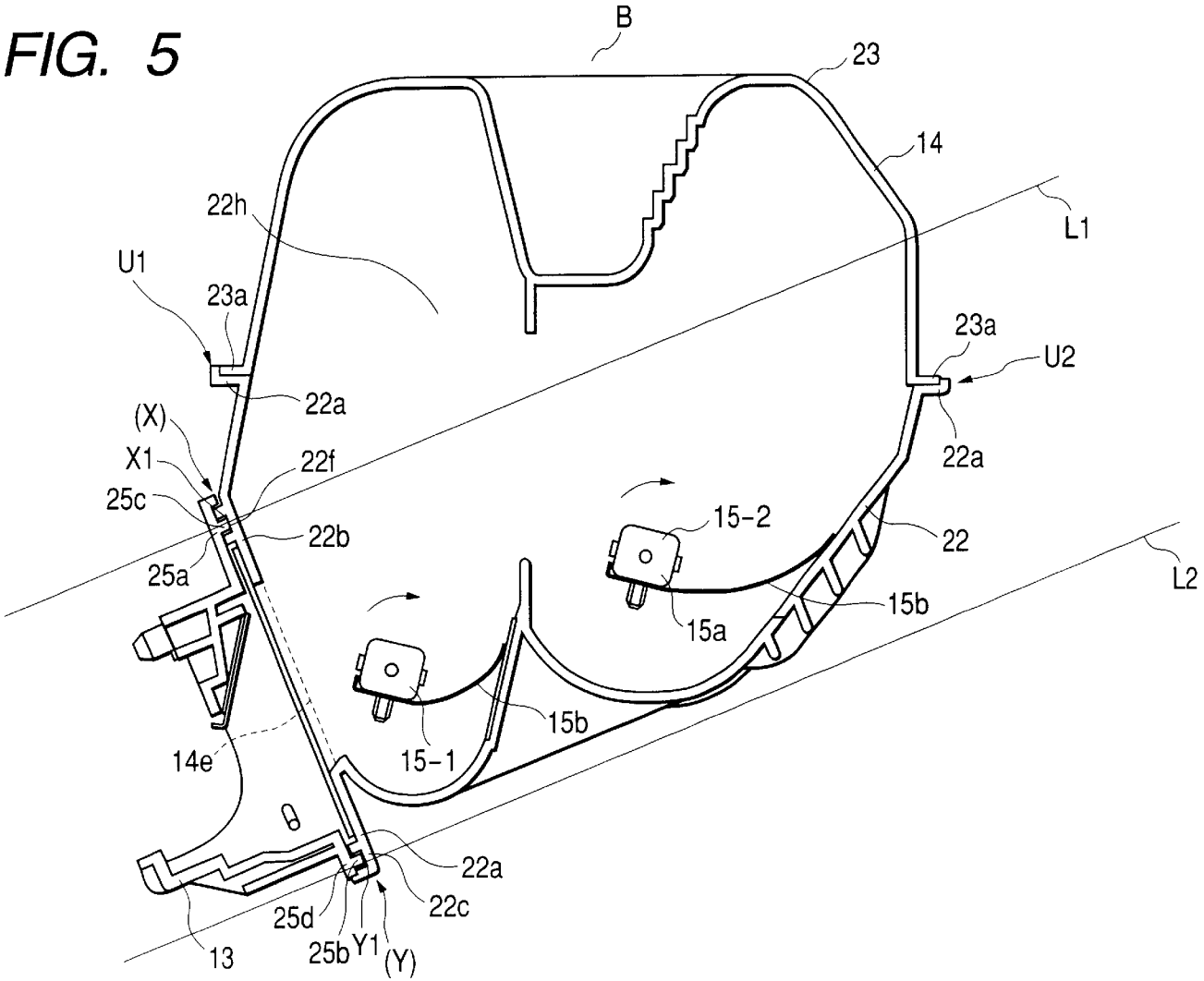
FIG. 5 is a schematic sectional view showing a connecting state of the developing frame and the developer container, to which a seal member is attached, of the process cartridge according to the embodiment of the invention.

As shown in FIGS. 2, 4 and 5, the developer container 14 is composed of the container frame 22 in the lower part and the lid frame 23 in the upper part. The container frame 22 and the lid frame 23 are connected at a welding plane U. A developer feeding opening 14*e* is formed in a side wall portion of the container frame 22. An opening 22*h* to be closed by the lid frame 23 is formed on the upper part of the container frame 22. Then, a flange 22*a*, which projects to the outside around the opening 22*h*, is provided integrally with a surrounding rib (counter lock) around the opening 22*h*. Moreover, the lid frame 23 as the lid member covers the opening 22*h* of the container frame 22. A flange 23*a*, corresponding to the flange 22*a* of the container frame 22, is projected outward from the periphery of the lid frame 23, and formed integrally with the lid frame 23. The flange 22*a* and the flange 23*a* are brought into contact with each other and welded so that the container frame 22 and the lid frame 23 are connected with each other. The connecting surface of the flange 22*a* and the flange 23*a* as a lid frame connection portion is the welding plane U. Accordingly, the flange 23*a* of the lid frame 23 is superimposed on the flange 22*a* of the container frame 22, and the welding plane U is subjected to the ultrasonic-welding so that the container frame 22 and the lid frame 23 are connected to each other by welding. Then, the frames 22 and 23 are integrated to form the developer container 14. As shown in FIG. 5, in the welding plane U, a lid frame connection portion located on one end side of the widthwise direction of the container frame 22 is designated by a reference character U1, and another lid frame connection portion located on the other end side is designated by a reference character U2.

As shown in FIGS. 2, 4 and 5, in a side wall portion, in which the developer feeding opening 14*e* is formed, of the container frame 22, a thread groove 22*f* extending in parallel to the edge portions of the developer feeding opening 14*e* on the upper and the lower sides thereof is formed on a wall surface 22*b* in the part above the developer feeding opening 14*e*. Moreover, a flange 22*c* is formed below the developer feeding opening 14*e* of the container frame 22. On the flange 22*c*, as shown in FIGS. 2, 4 and 5, a thread groove 22*g* extends parallel to the edge portions of the developer feeding opening 14*e* similarly to the thread groove 22*f*.

Figure 6A:
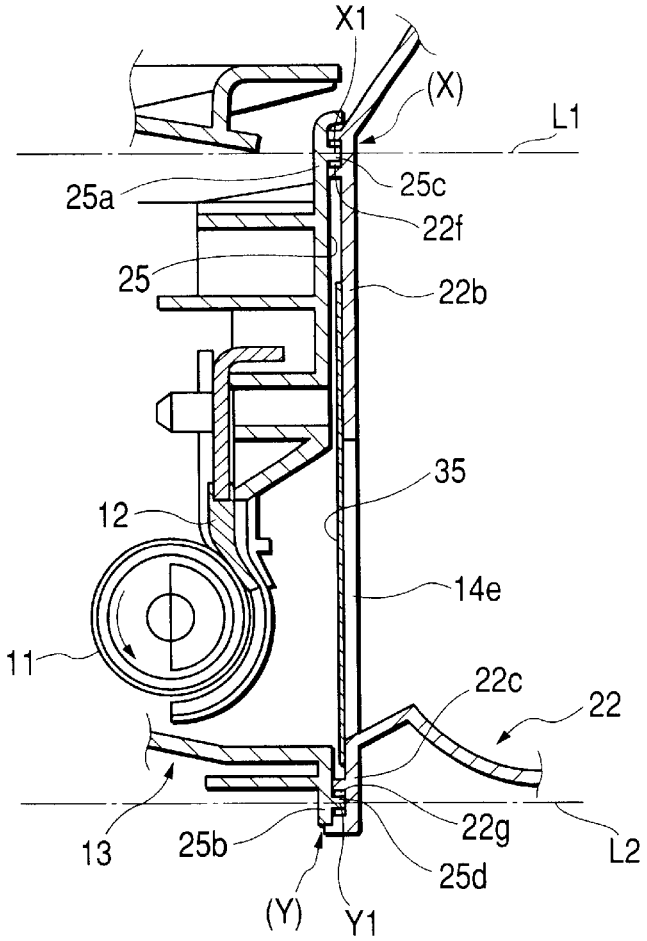
FIG. 6A is a sectional view for illustrating a connection portion of the container frame of the developer container and the developing frame of the process cartridge according to the embodiment of the invention.
Figure 6B:
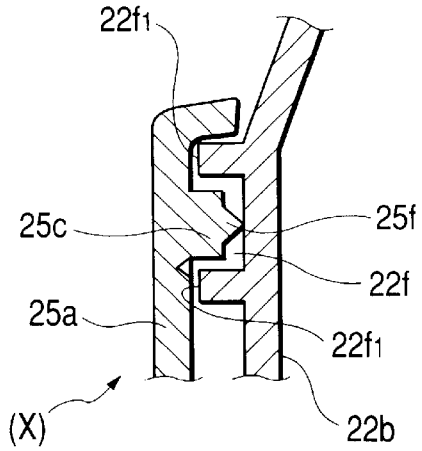
FIG. 6B and FIG. 6C are enlarged sectional views of connection portions X and Y of the container frame and the developing frame, respectively.
Figure 6C:
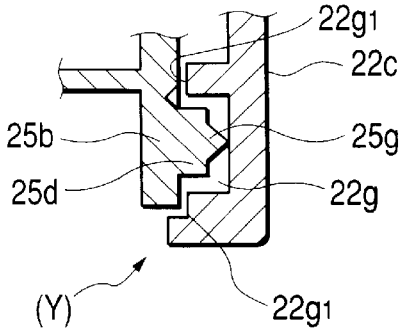
Figure 7:
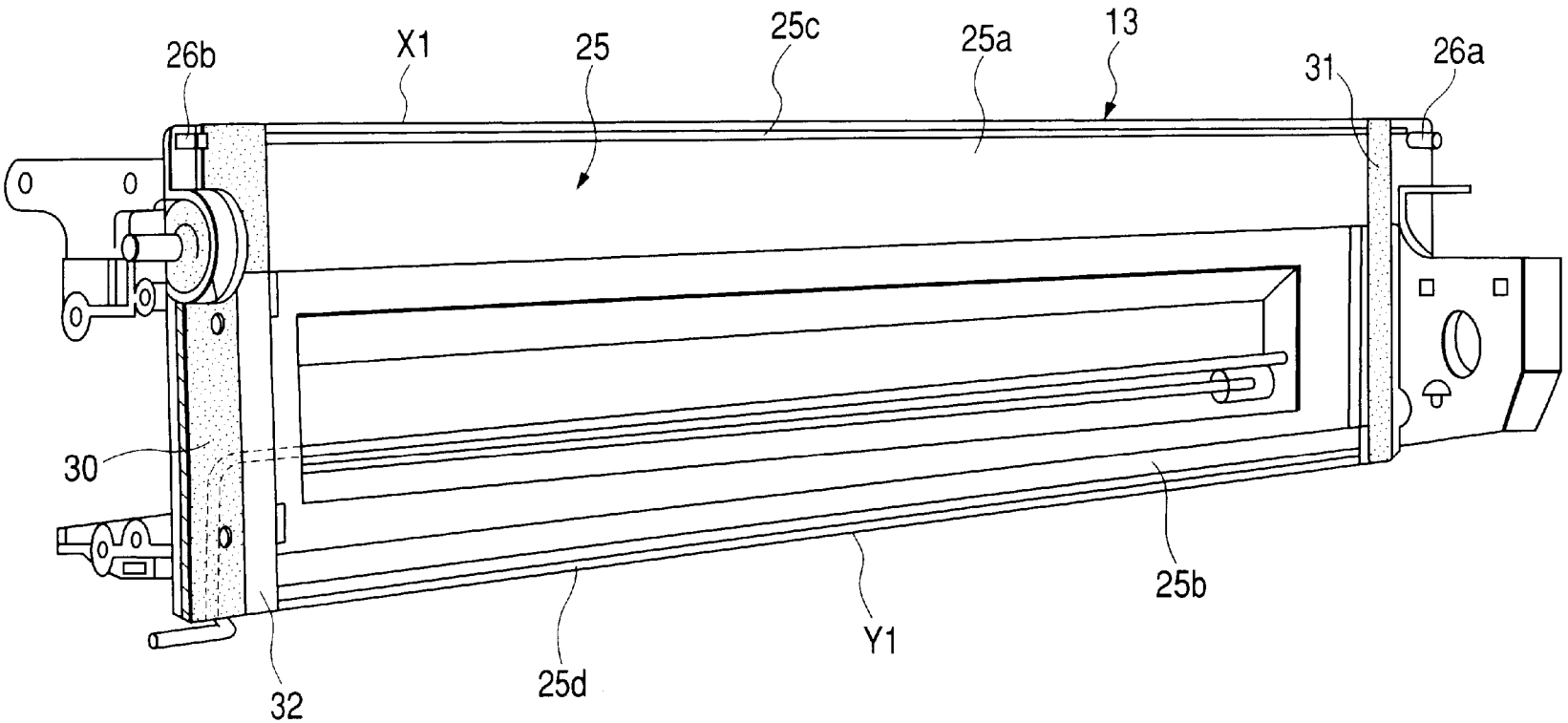
FIG. 7 is a perspective view showing a connecting surface of the developing frame of the process cartridge according to the embodiment of the invention.

Furthermore, on an opposite surface 25, which is opposed to the container frame 22, of the developing frame 13, as shown in FIGS. 2 and 4–7, flanges 25*a* and 25*b* opposed to the wall surface 22*b* and the flange 22*c* of the container frame 22, respectively, are formed. Moreover, on the flanges 25*a* and 25*b*, protruded threads 25*c* and 25*d* extending in the lengthwise directions are respectively formed. The protruded thread 25*c* of the flange 25*a* is disposed to be opposed to the thread groove 22*f* formed on the wall surface 22*b* of the container frame 22 to be fitted into the thread groove 22*f*. And, the protruded thread 25*d* of the flange 25*b* is disposed to be opposed to the thread groove 22*g* formed on the flange 22*c* of the container frame 22 to be fitted into the thread groove 22*g*. Incidentally, protruded threads 25*f* and 25*g* (see FIG. 6B and FIG. 6C) having a triangular cross section for the ultrasonic welding are formed on the top surfaces of the protruded threads 25*c* and 25*d*, respectively. Incidentally, as shown in FIG. 7, on the opposite surface 25, which is opposed to the container frame 22, of the developing frame 13, a cylindrical dowel 26*a* and a rectangular dowel 26*b*, both being for positioning the developing frame 13, are formed on both end portions in the upper part of the opposite surface 25, respectively. A circular hole 27*a* and a rectangular hole 27*b* (see FIG. 8) disposed to be fitted onto the dowels 26*a* and 26*b*, respectively, are formed on the container frame 22 in correspondence with the dowels 26*a* and 26*b* for positioning. The circular hole 27*a* is fitted onto the dowel 26*a* closely. The rectangular hole 27*b* engages with the rectangular dowel 26*b* closely in the widthwise direction (or the vertical direction in FIGS. 7 and 8) and loosely in the lengthwise direction (or the horizontal direction in FIGS. 7 and 8). Incidentally, in FIG. 7, reference numerals 30 and 31 designate seal members. The seal members 30 and 31 are made of an elastic material such as a felt, and are respectively attached to the end portions in the lengthwise direction of the opposite surface 25, which is opposed to the container frame 22, of the developing frame 13. A reference numeral 32 designates a tape. The tape 32 is a synthetic resin film having a small friction coefficient. The tape 32 is attached on the inner portion of one side seal member 30.

When the container frame 22 and the developing frame 13, both being configured as mentioned above, are connected and assembled, the wall surface 22*b* and the flange 22*c* of the container frame 22 are respectively abutted against the flanges 25*a* and 25*b* of the developing frame 13. At this time, the dowel 26*a* of the developing frame 13 is fitted into the hole 27*a* of the container frame 22, and the dowel 26*b* of the developing frame 13 is engaged with the hole 27*b* of the container frame 22. Consequently, the positioning dowels 26*a* and 26*b* of the developing frame 13 are respectively fitted into the positioning holes 27*a* and 27*b* of the container frame 22. Then the positioning of the developing frame 13 and the container frame 22 are performed. Moreover, the protruded threads 25*c* and 25*d* of the developing frame 13 are fitted into the thread grooves 22f and 22*g* of the container frame 22. In such a way, the container frame 22 and the developing frame 13 are brought into pressure contact with each other. Thereby, the seal members 30 and 31 disposed on both the end portions of the opposite surface 25 of the developing frame 13 are brought into contact with the container frame 22, and are compressed by the container frame 22. The thread grooves 22*f* and 22*g* of the container frame 22 and the protruded threads 25*c* and 25*d* of the developing frame 13 are fitted to each other, and are connected to each other by ultrasonic welding as it will be described later. Incidentally, a seal member 35 for covering the developer feeding opening 14*e* is attached to the peripheral portion of the developer feeding opening 14*e* by hot welding as it will be described later (see FIG. 8 and FIG. 9).

In the container frame 22 and the developing frame 13 being welded to each other by the ultrasonic welding as described above, two connection portions X and Y of the container frame 22 and the developer frame body 13 are respectively disposed at an upper position and a lower position on the same plane (at the positions at the upper peripheral portion and the lower peripheral portion of the developer feeding opening 14*e*) with the attaching portion of the aforesaid seal member 35 being put between the upper position and the lower position (see FIGS. 2, 5 and 6A–6C). The connection portion X is a first developing frame connection portion of the thread groove 22*f* on the wall surface 22*b* with the protruded thread 25*c* on the flange 25*a*. The connection portion Y is a second developing frame connection portion of the thread groove 22*g* on the flange 22*c* with the protruded thread 25*d* of the flange 25*b*. And, the lid frame connection portion U1 located on one end side in the widthwise direction of the container frame 22 is located on the outside of a plane L1 perpendicular to the developing frame connection portion X. The plane L1 passes through an outside end portion X1 in the widthwise direction of the developing frame connection portion X formed along the lengthwise direction of the developer feeding opening 14*e* on one end in the widthwise direction of the developer feeding opening 14*e*. Incidentally, the developing frame connection portion X is not located on the flange portion, but is located on the opposite side to the side of the container frame 22 on which developer is contained, namely on the back side of the portion in which the developer is contained.

Figure 15:
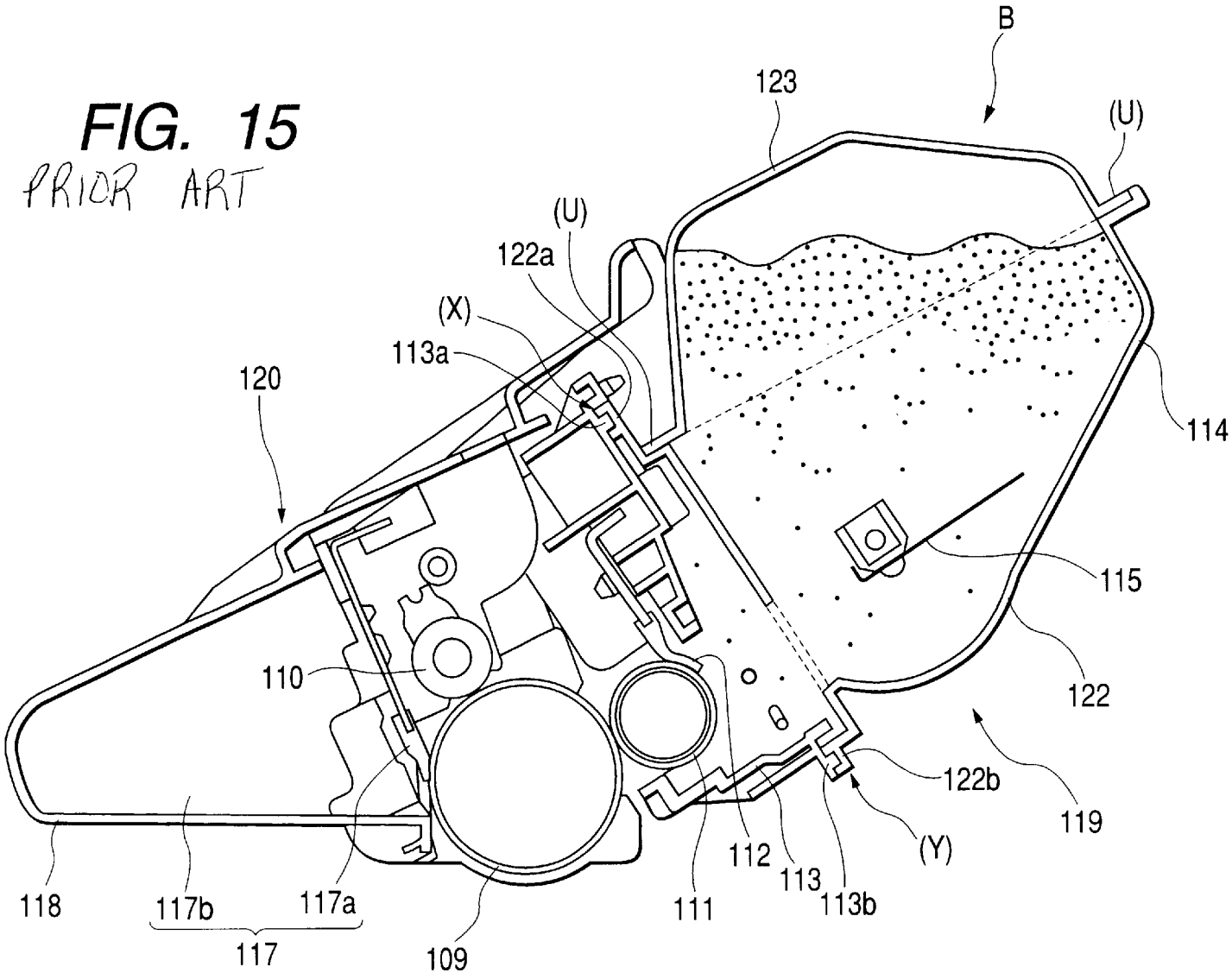
FIG. 15 PRIOR ART
FIG. 15 is a sectional schematic view showing a conventional process cartridge.
Figure 16:
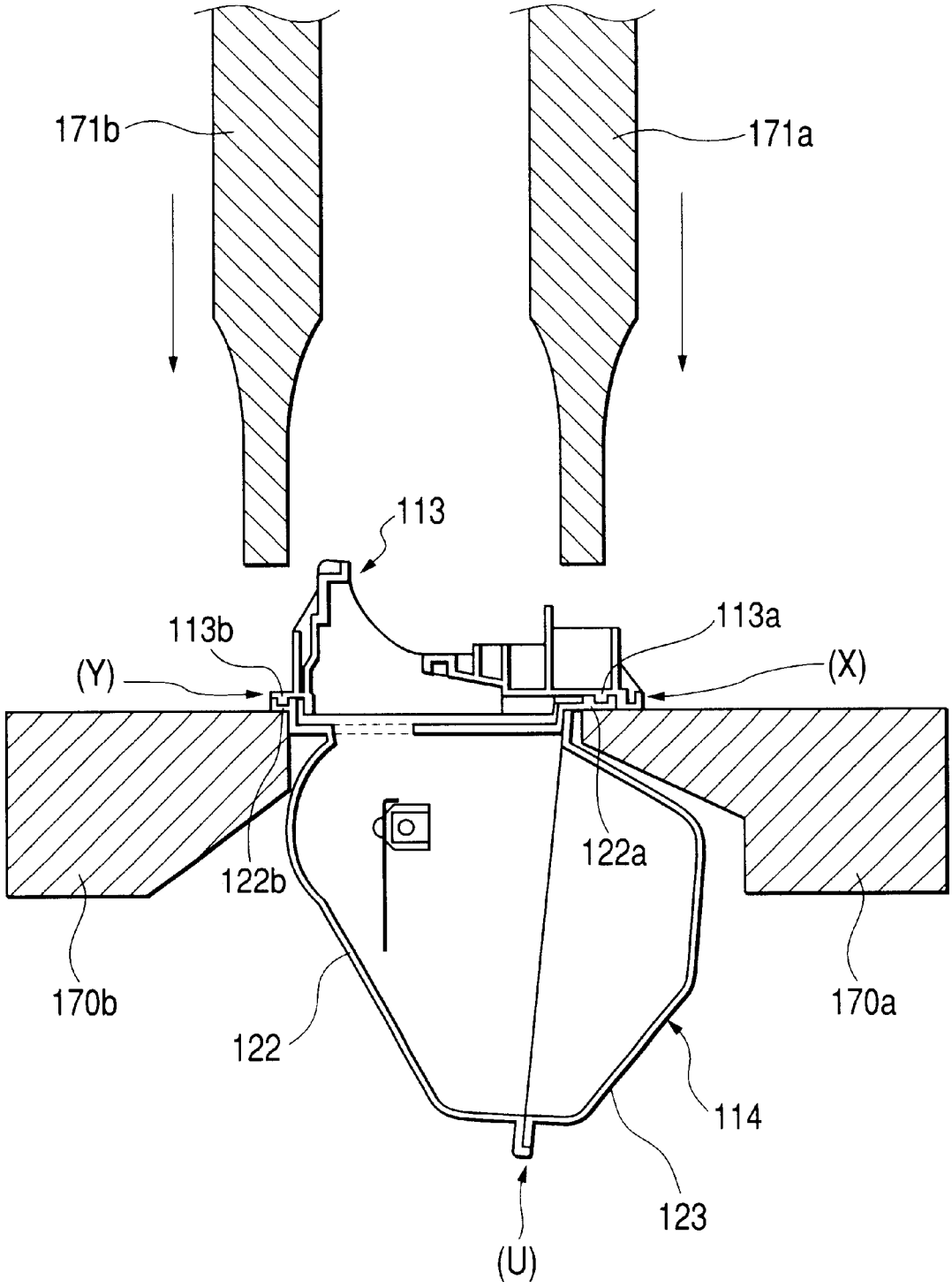
FIG. 16 PRIOR ART
FIG. 16 is a schematic detailed view showing connection portions of a developing frame and a container frame of the conventional process cartridge.

In the related art described above (see FIGS. 15 and 16), the welding plane U is disposed between the two connection portions X and Y of the container frame 122 and the developing frame 113, and spaces are formed between the welding plane U and the two connection portions X and Y. The spaces are the dead spaces in which developer cannot be contained. However, in the present embodiment, the lid frame connection portion U1 located on one end side in the widthwise direction of the container frame 22 is located on the outside of the plane L1 perpendicular to the developing frame connection portion X. The plane L1 passes through the outside end portion X1 (or an outside end portion X1 of the protruded thread 25*c* and the thread groove 22*f* constituting the developing frame connection portion X in the present embodiment; see FIGS. 5 and 6A) in the widthwise direction of the developing frame connection portion X formed along the lengthwise direction of the developer feeding opening 14*e* on one end in the widthwise direction of the developer feeding opening 14*e*. Then, as shown in FIG. 5, the lid frame connection portion U1 located on the one end in the widthwise direction of the container frame 22 and the lid frame 23 are connected at a position outside and above the connection portion X. Consequently, the dead space can be utilized as developer containing portion.

Incidentally, the outside of the perpendicular plane L1 means the opposite side to the center of the developer feeding opening 14*e* in the widthwise direction. Moreover, the word "above" refers to the state of one element being higher than another element when the developer container 14 is mounted in the apparatus main body. Besides, the perpendicular plane L1 is parallel to the connection portion X, i.e. the protruded thread 25*c* and the thread groove 22*f*. And the plane L1 is substantially perpendicular to the developing frame 13.

Incidentally, in the present embodiment, the configuration of the lid frame connection portion U1 is not applied to the lid frame connection portion U2. However, if the embodiment is also applied to the connection portion U2, the configuration of the connection portion U2 is as follows.

That is, the lid frame connection portion U2 located on the other end side of the widthwise direction of the container frame 22 is disposed outside a plane L2 perpendicular to the developing frame connection portion Y. The plane L2 passes through an outside end portion Y1 in the widthwise direction of the developing frame connection portion Y formed along the lengthwise direction of the developer feeding opening 14*e* on the other end in the widthwise direction of the developer feeding opening 14*e*.

In this case, the connection portion Y is not located on the flange portion, but is located on the opposite side to the side of the container frame 22 on which developer is contained, namely on the back side of the portion in which the developer is contained. Consequently, the arrangement and the configuration of the connection portion Y and the connection portion U2 are similar to those of the connection portion X and the connection portion U1 that are shown in FIGS. 5 and 6A. Accordingly, any drawing showing the arrangement and the configuration of the connection portion Y and the connection portion U2 is omitted.

Moreover, if the protruded threads 25*f* and 25*g*, which have the triangular cross sections and are welding ribs, of the developing frame 13 are formed on the container frame 22, the container frame 22 and the developing frame 13 can similarly be connected. Resins such as a polystyrene resin, an acrylonitrile-butadiene-styrene (ABS) copolymer resin, a polycarbonate resin, a polyethylene resin, a polypropylene resin, a poly phenylene oxide (PPO) resin, and the like can be used as the materials for forming the container frame 22, the lid frame 23 and the developing frame 13.

Figure 8:
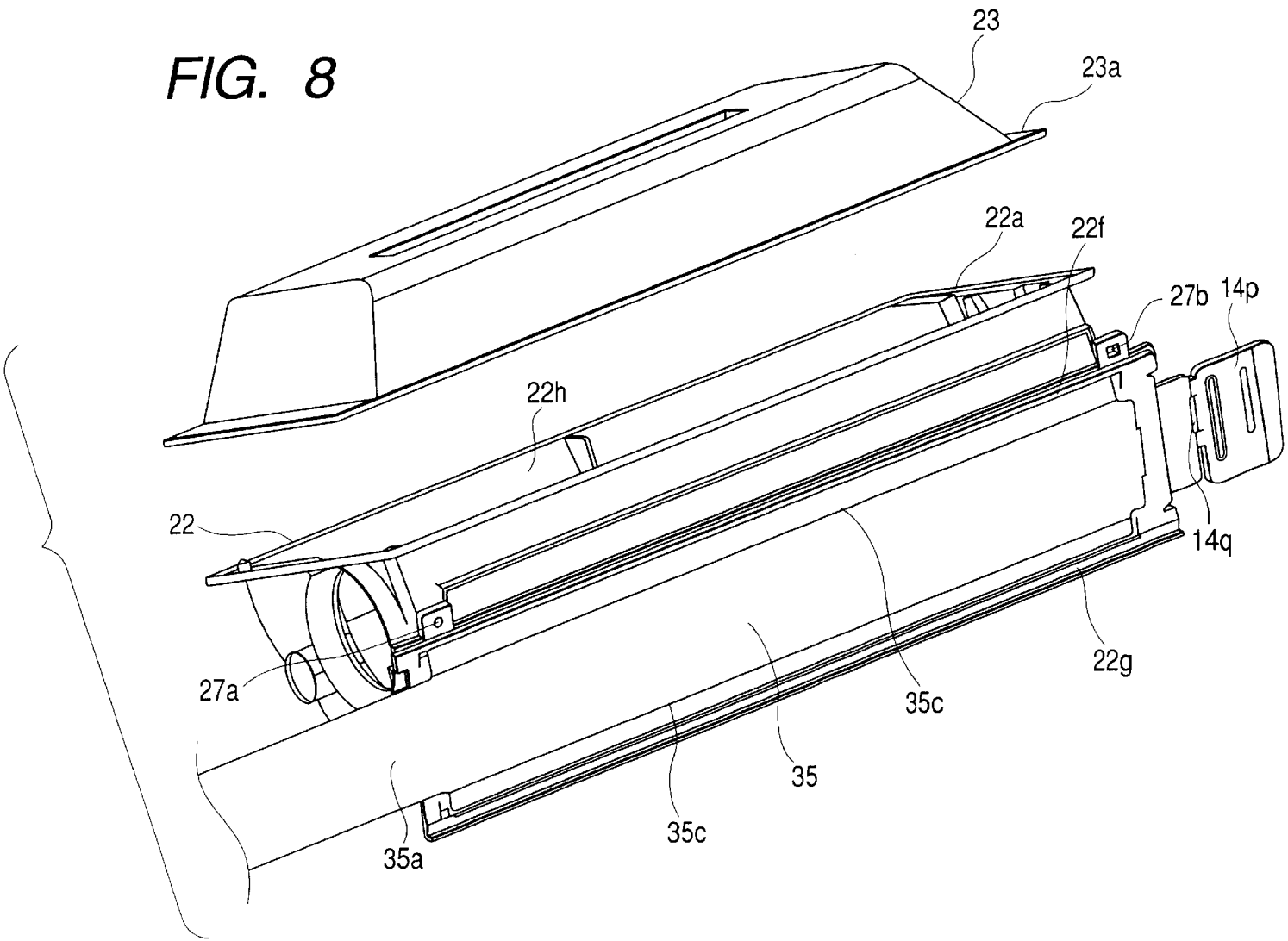
FIG. 8 is a perspective view showing a state in that the seal member is to be attached to the container frame of the process cartridge according to the embodiment of the invention.

Next, the seal member 35 for covering the developer feeding opening 14*e* will be described in detail. The seal member 35 is composed of an aluminum (Al) film, polyethylene terephthalate (PET) films formed on the upper and lower sides of the Al film, and a hot welding layer (or a sealant layer) on the attachment surface of the seal member 35, all layers being laminated on top of one another. As shown in FIGS. 5, 6A and 8, the seal member 35 is attached to cover the developer feeding opening 14*e* of the developer container 14 (or the container frame 22). In the seal member 35, slits 35*c* extending along the lengthwise direction on each of the upper and the lower end portions of one layer of the laminated PET films are provided to make it easy to tear the seal member 35 when the developer feeding opening 14*e* is to be opened. An opening operation, which will be described later, tears the seal member 35 along the slits 35*c* to open the developer feeding opening 14*e* of the developer container 14.

Figure 9:
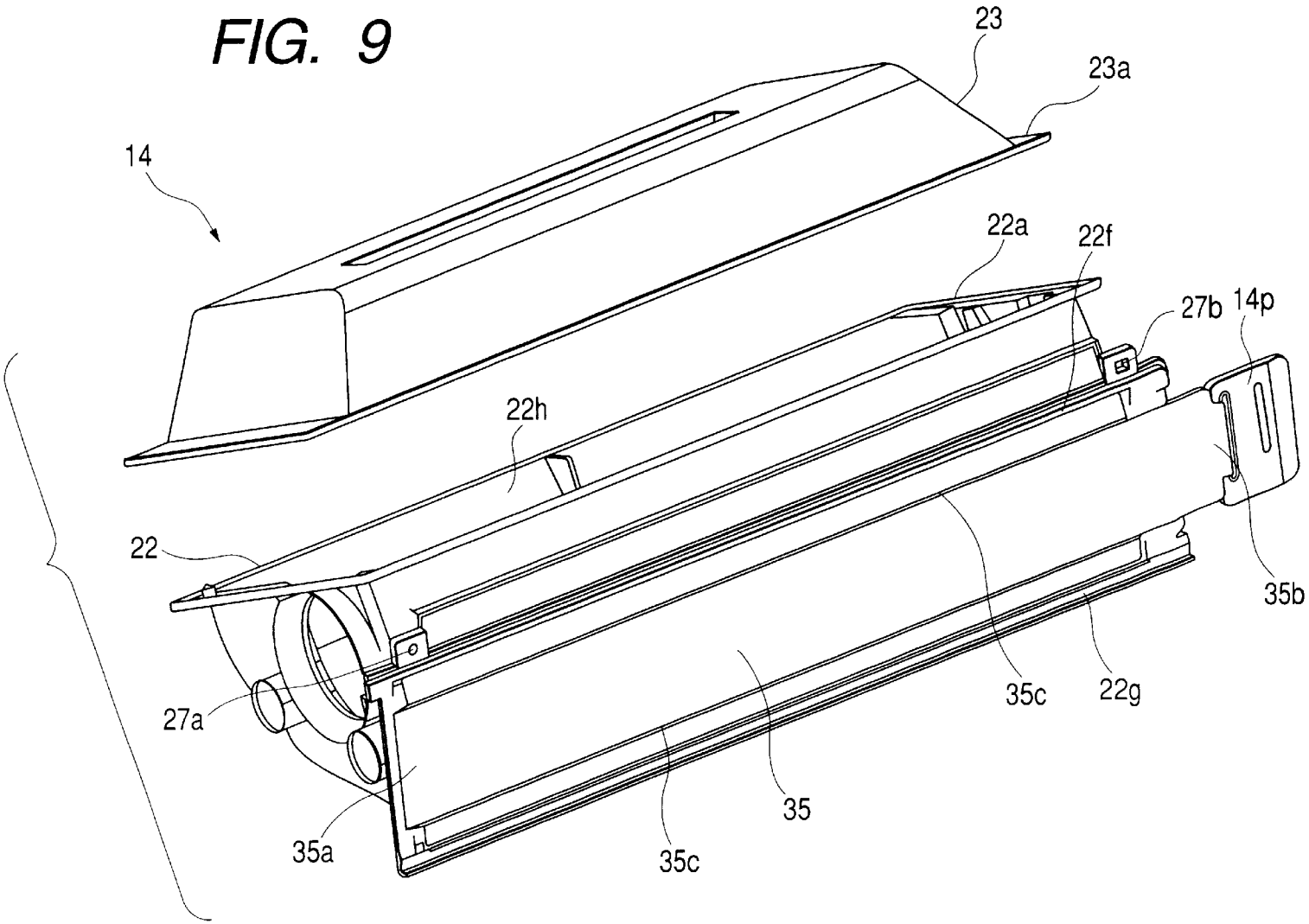
FIG. 9 is a perspective view showing a state in that the seal member has been attached to the container frame of the process cartridge according to the embodiment of the invention.
Figure 10:
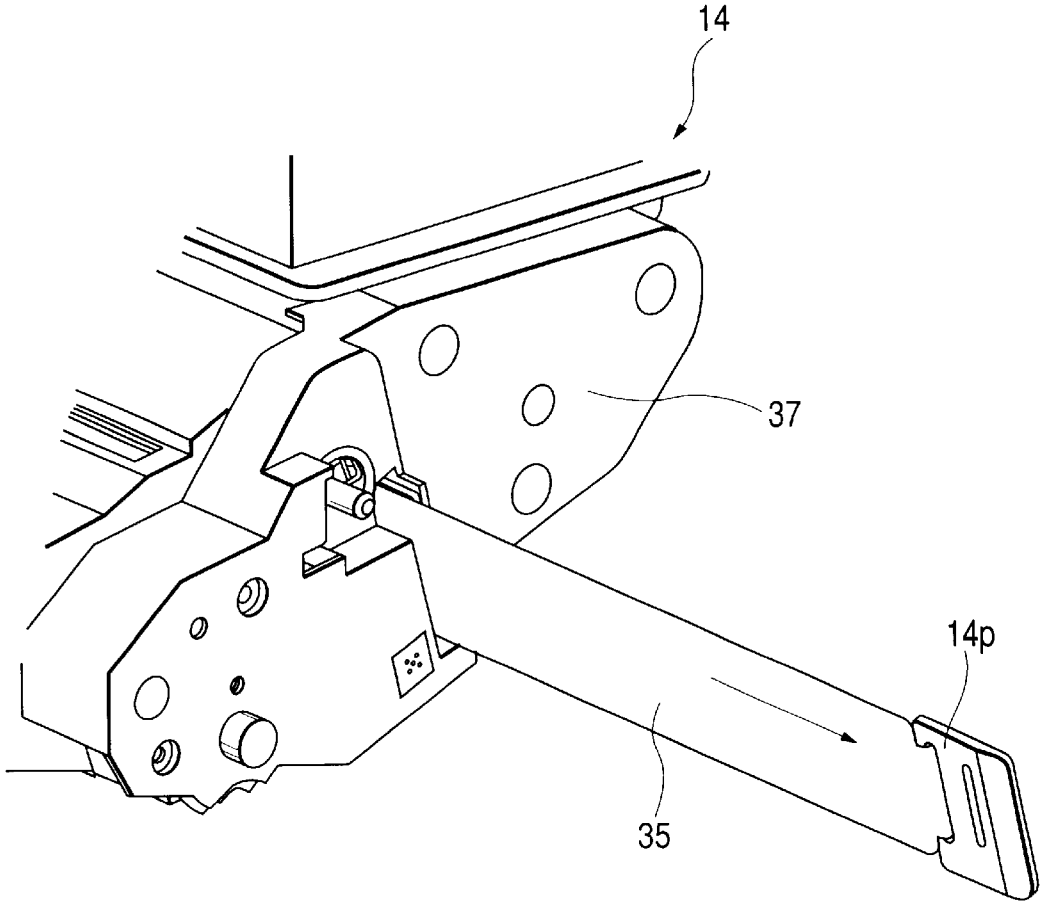
FIG. 10 is a perspective view for illustrating a method of drawing the seal member of the process cartridge according to the embodiment of the invention.

As shown in FIG. 8 and FIG. 9, the seal member 35 has a length twice as long as that of the developer feeding opening 14*e* in the lengthwise direction or more. Almost the half of the length of the seal member 35 is attached to the peripheral portions of the developer feeding opening 14*e*. The other portion of the seal member 35, which is not attached, is folded back at one end portion 35*a* in the lengthwise direction of the developer feeding opening 14*e* to be put on the attached half portion, and then the end portion of the folded portion is drawn out from the end portion on the other side of the opening 14*e* to the outside thereof.

When the developer container 14 provided with the seal member 35 attached to the peripheral portions of the developer feeding opening 14*e* and the developing frame 13 are connected integrally with each other, as shown in FIG. 7, the seal member 35 is brought into contact with and urged against the seal member 30 such as a felt attached to the end portions in the lengthwise direction of the opposite surface 25, which is opposed to the container frame 22, of the developing frame 13, and then the seal member 35 is drawn out to the outside through between the developer container 14 (or the container frame 22) and the developing frame 13. Incidentally, the tape 32, which is made from a synthetic resin film and has a small friction coefficient, is attached on the surface of the seal member 30 on the inner side thereof. Moreover, the seal member 31 is attached to the end portion, opposed to the position where the seal member 30 is attached, of the opposite surface 25 in the lengthwise direction.

The end portion (a grip end portion) 35*b*, drawn to the outside, of the seal member 35 is attached to a grip member 14*p* being a handgrip. The grip member 14*p* is formed integrally with the developer container 14. The thickness of a connection portion 14*q* of the grip member 14*p* for connecting the grip member 14*p* with the developer container 14 is made to be especially thin to make it possible to tear the grip member 14*p* off the developer container 14. Moreover; the grip member 14*p* is bent by about 90 degrees (see FIG. 3) and is packed in order that the whole length of the packed cartridge B becomes shorter and that the packing efficiency is good when the cartridge B is packed. A user raises the grip member 14*p* and cuts off the grip member 14*p* at the thin (frangible) connection portion 14*q* to draw the seal member 35 in the direction indicated by an arrow in FIG. 10. Thereby, the seal member 35 is torn off along the slits 35*c*, and then the developer feeding opening 14*e* of the developer container 14 is opened. Then, the developer in the developer container 14 is fed into the developing frame 13 through the developer feeding opening 14*e*, and it becomes possible to use the cartridge B.

Next, a method of connecting the developing device unit will be described in the order of processes with reference to FIG. 11 to FIG. 13.

Figure 11:
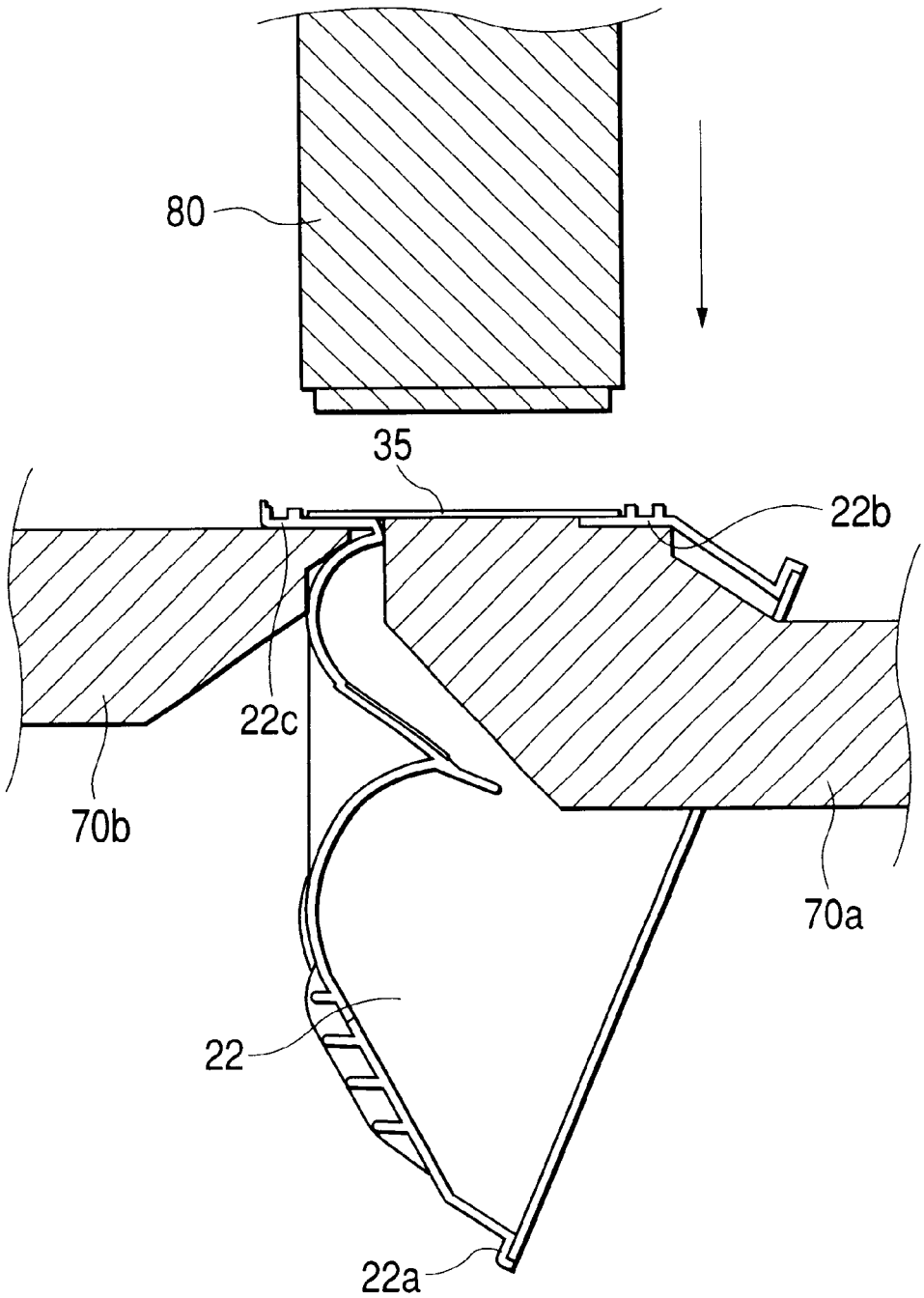
FIG. 11 is a schematic, sectional, explanatory view showing a process of attaching the seal member to a developing device unit of the process cartridge according to the embodiment of the invention.

(i) Attaching Process of the Seal Member 35 (FIG. 11)

At first, the seal member 35 is attached to the developer feeding opening 14*e* of the container frame 22 constituting the developer container 14 by hot welding in order to cover the developer feeding opening 14*e*.

As shown in FIG. 11, the container frame 22 is fixed on receiving jigs 70*a* and 70*b* so that the receiving jigs 70*a* and 70*b* hold the wall surface 22*b* and the flange 22*c* of the container frame 22, respectively. After that, the seal member 35 is set on the developer feeding opening 14*e*. In such a state, a hot welding jig 80 is made to descend to press the seal member 35. Then, the hot welding jig 80 melts the hot welding layer (the sealant layer) of the seal member 35 while the hot welding jig 80 makes the seal member 35 closely adhere to the peripheral portions of the developer feeding opening 14*e*.

Figure 12:
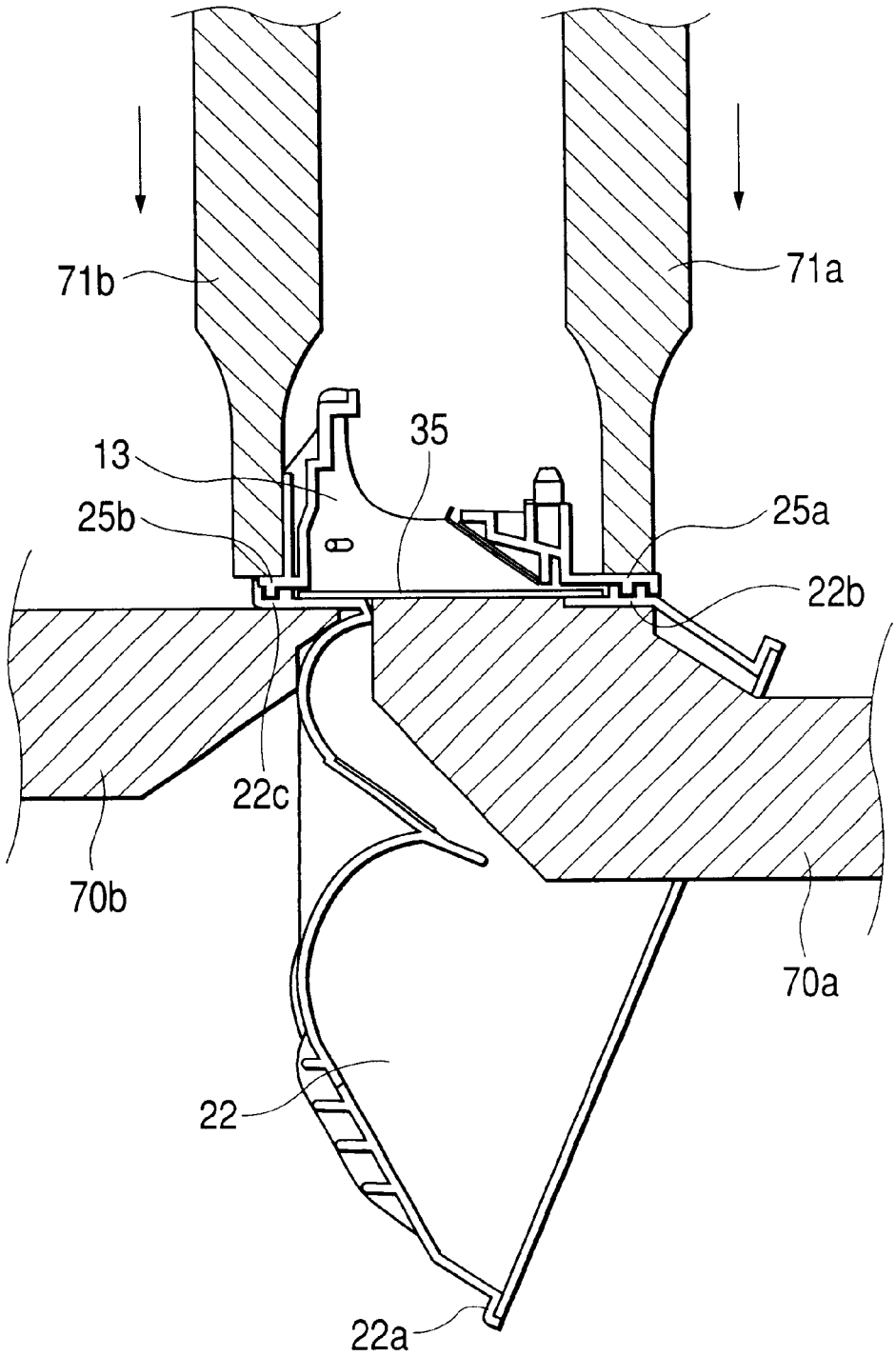
FIG. 12 is a schematic, sectional, explanatory view showing a process of connecting the developing frame and the container frame of the developing device unit of the process cartridge according to the embodiment of the invention.

(ii) Connecting Process of the Developing Frame 13 and the Container Frame 22 (FIG. 12)

Next, the developing frame 13 is connected to the container frame 22 with the seal member 35 attached thereto by the ultrasonic welding.

As shown in FIG. 12, after the container frame 22 is fixed by the receiving jigs 70*a* and 70*b* so that the wall surface 22*b* and the flange 22*c* of the container frame 22 are held by the receiving jigs 70*a* and 70*b*, respectively, the developing frame 13 is placed on the fixed container frame 22. At this time, as shown in FIGS. 6A, 6B and 6C in detail, the protruded threads 25*c* and 25*d* of the developing frame 13 are respectively fitted into the thread grooves 22*f* and 22*g* formed on the wall surface 22*b* and the flange 22*c* of the container frame 22, respectively. Then, the welding horns 71*a* and 71*b* descend to press the flanges 25*a* and 25*b* of the developing frame 13 to the wall face 22*b* and the flange 22*c* of the container frame 22, respectively. Then, ultrasonic vibrations are applied to the protruded threads 25*c* and 25*d* and the thread grooves 22*f* and 22*g* to melt with friction heat the protruded threads 25*f* and 25*g*, each of which has a triangular cross section, and which are formed at the end portions of the protruded threads 25*c* and 25*d*, respectively, and then the protruded threads 25*c* and 25*d* are connected with the bottom portions of the thread grooves 22*f* and 22*g* by the welding. Thereby, the upper and the lower edges $\mathbf{22}f_1$ and 22*g*, of the thread grooves 22*f* and 22*g* of the container frame 22 abut against the flanges 25*a* and 25*b* of the developing frame 13 so that the container frame 22 and the developing frame 13 are connected with each other. Consequently, as shown in FIG. 6A, a space is formed between the surfaces, which are opposed to each other with a predetermined distance, while the surrounding ribs are closely connected to each other. Then, the seal member 35 is disposed in the space.

In this case, the receiving jigs 70*a* and 70*b* receive the same surfaces of the container frame 22 as those in the attaching process of the seal member in the above item (i).

Figure 13:
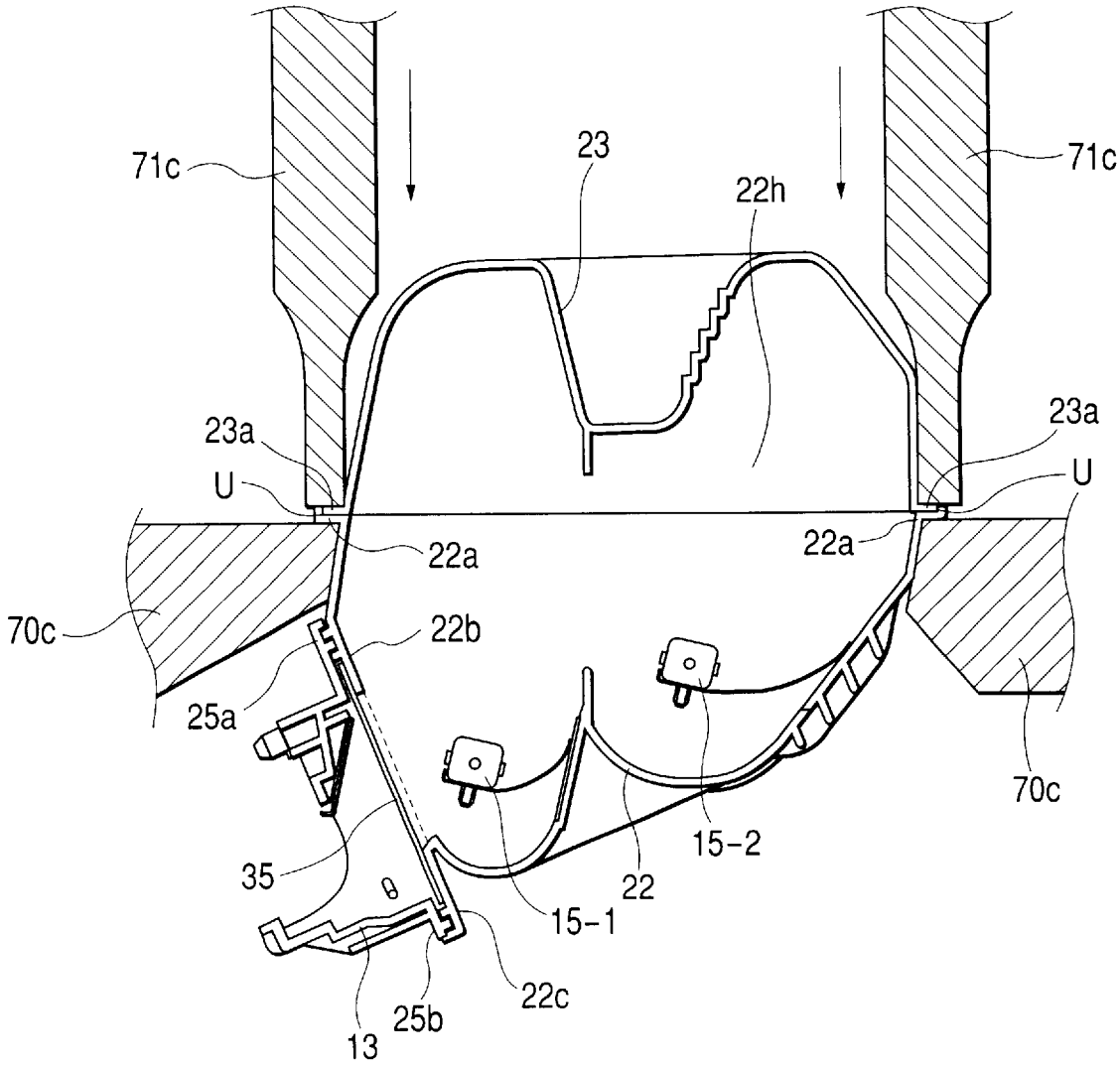
FIG. 13 is a schematic, sectional, explanatory view showing a process of connecting a lid frame to the container frame of the developing device unit of the process cartridge according to the embodiment of the invention.

(iii) Connecting Process of Lid Frame 23 (FIG. 13)

Next, the lid frame 23 is connected to the container frame 22, to which the developing frame 13 is connected, by the ultrasonic welding.

As shown in FIG. 13, after the agitating members 15-1 and 15-2 are incorporated into the container frame 22 connected to the developing frame 13, the container frame 22 is fixed on the receiving jig 70*c* so that the receiving jig 70*c* receives the entire circumference of the back side of the flange 22*a* of the welding plane U. Then, the flange 23*a* of the lid frame 23 is placed on and aligned with the flange 22*a* of the container frame 22, and the lid frame 23 is fixed on the container frame 22. After that, the welding horn 71*c* descends and is operated to weld and connect the flange 23*a* to the flange 22*a* by the ultrasonic welding. In such a way, the flange 22*a* of the container frame 22 is fitted to the flange 23*a* of the lid frame 23. Then, the flanges 22*a* and 23*a* are connected together on the welding plane U by melting the welding ribs with the ultrasonic welding so that the frames 22 and 23 are formed into a unitary body in the shape of a container.

The thus connected developer container 14 is filled with developer. And, parts such as the developing roller 11, the developing blade 12 and the like are incorporated into the developing frame 13. Thereby, the developing device unit 19 is completed.

Then, the completed developing device unit 19 and the photosensitive member unit 20 are flanked by the side covers (L) 37 and (R) 38 at the opposed ends thereof and connected integrally into a process cartridge B.

Although the example of the method, which uses ultrasonic welding, of connecting the frames is described in the aforementioned embodiments, the method of connecting the frames according to the present invention is not limited to ultrasonic welding. Any method capable of connecting frames may be applied as the method of connecting the frames according the present invention. The frames may be connected by, for example, screwing, hot welding, vibration welding, adhesives, and the like.

Likewise, as for the method of attaching the seal member, the seal member may be effectively attached by adhesion, ultrasonic welding, and the like as the embodiments.

Moreover, although the example, in which the lid frame is connected to the container frame for the formation of the developer container, is described in the embodiments of the present invention, it is not necessary that the lid frame 23 closes the top opening of the container frame 22. Any configuration for connecting a plurality of frames can obtain the similar advantages. As in the embodiments described above, the developer container can increase its containing capacity of developer by being provided with the lid frame. This is because developer can also be contained in the portion of the lid frame.

Figure 14:
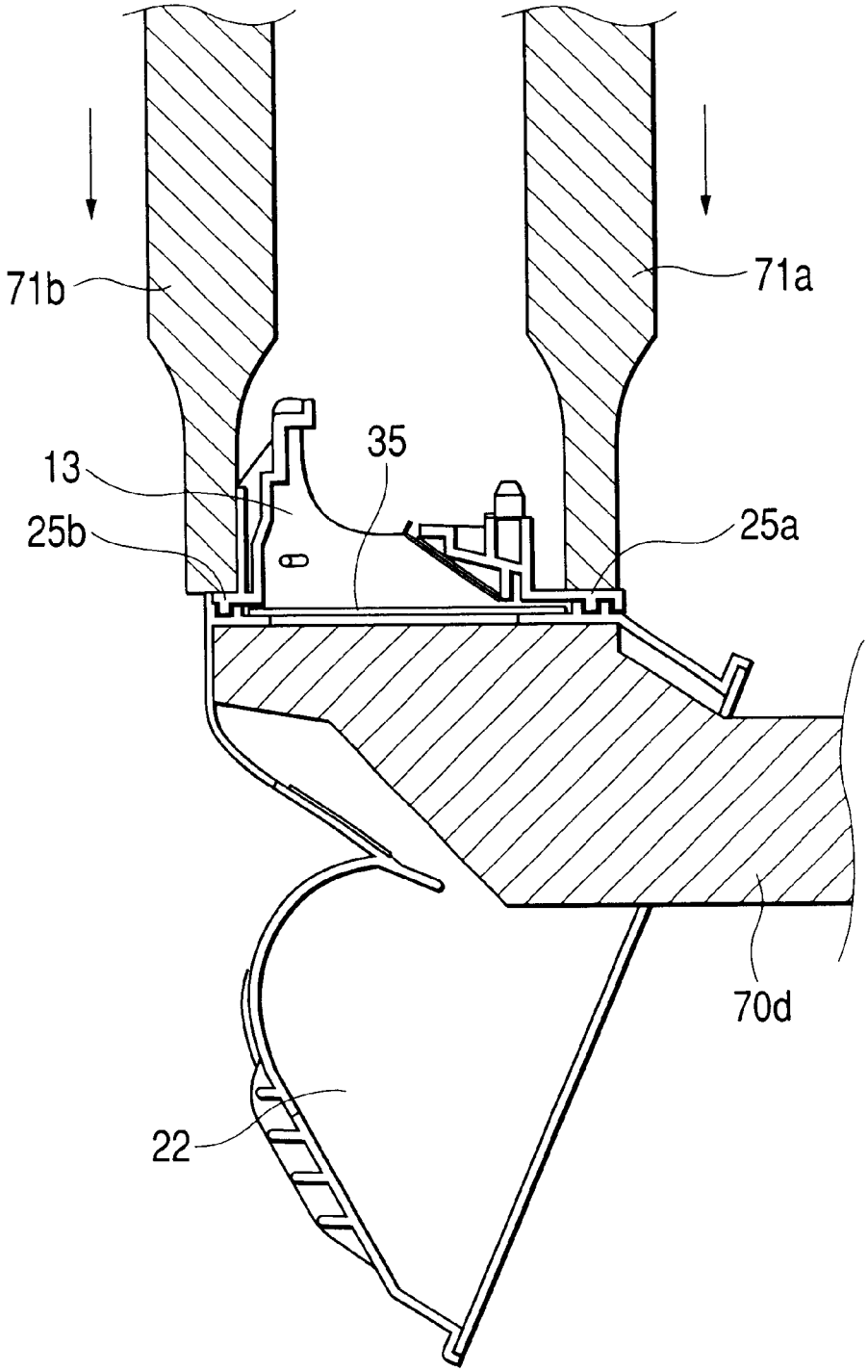
FIG. 14 is a schematic, sectional, explanatory view showing a process of connecting a developing frame and a container frame of a developing device unit of a process cartridge according to another embodiment of the invention.

Incidentally, in the embodiments described above, the configuration such that the flange on the upper side of the developer feeding opening 14*e* of the container frame 22 is removed for providing an additional developer containing space is described. However, the configuration on the opposite side (the lower side) of the developer feeding opening 14*e* may similarly be configured to remove the flange 22*c*. In this case, as shown in FIG. 14, the configuration of the container frame 22 is one in which an integral ultrasonic receiving jig 70*d* is inserted into the container frame through its opening for connecting the lid frame to receive both the connection portions on the inner surfaces of the container frame. Incidentally, if the removal of either or both of the flanges is realized in the container frame, the configuration is included in the scope of the present invention. The reason is that even the removal of either of the flanges can bring about advantages of the present invention. In case of the removal of both the flanges, the further advantages of the present invention can be obtained.

As described above, the present invention adopts the configuration of a developer container that does not need a flange of at least one portion for the connection of a container frame and a developing frame. Thereby, the developer containing space of the developer container can effectively be utilized. Consequently, the capacity of the developer container can be increased without the increase of the sizes of a process cartridge and the main body of an image forming apparatus. That is, the present invention can increase the capacity of the developer container.

While the invention has been described with reference to the structure disclosed herein, it is not confined to the details set forth and this application is intended to cover such modifications or changes as may come within the purposes of the improvements or the scope of the following claims.

What is claimed is:

1. A developer container to be used in a main body of an electrophotographic image forming apparatus, said developer container containing developer to be used for development of an electrostatic latent image formed on an electrophotographic photosensitive member by a developing member, said developer container comprising:

a container frame provided with an opening and a developer feeding opening for feeding the developer to a developing frame, in which the developing member is disposed; and a lid frame connected to said container frame to close said opening of said container frame, wherein said container frame has a lid frame connection portion to which said lid frame is connected at a peripheral portion of said opening, and a developing frame connection portion to which the developing frame is connected so that said container frame communicates with the developing frame through said developer feeding opening, and wherein said lid frame connection portion is located at least on one end side in a widthwise direction of said container frame, and said lid frame connection portion is located outside a plane perpendicular to said developing frame connection portion, the plane passing through an outer end portion in said widthwise direction of said developing frame connection portion being provided along a lengthwise direction of said developer feeding opening at an end in said widthwise direction of said developer feeding opening, and wherein a jig receiving portion is disposed inside said container frame, and said jig receiving portion receives a jig for supporting said developing frame connection portion when said developing frame connection portion is welded to the developing frame.

2. A developer container according to claim 1, wherein a removable seal member for closing said developer feeding opening is attached to said container frame by hot welding, and a surface of said container frame for receiving the seal member attached by the hot welding is arranged on substantially the same plane as a surface of said container frame for receiving the developing frame connected to said container frame.

3. A developer container according to claim 1 or 2, wherein said container frame is provided with a container flange formed integrally with said container frame, said container flange protruding outward from the peripheral portion of said opening, and said lid frame is provided with a lid flange formed integrally with said lid frame, said lid flange protruding outward from a peripheral portion of said lid frame, and said lid frame connection portion comprises said container flange and said lid flange.

4. A developer container according to claim 1 or 2, wherein said container frame and said lid frame are connected by a screw, an adhesive, ultrasonic welding, hot welding, or vibration welding.

5. A developer container according to claim 1 or 2, wherein said container frame and the developing frame are connected by ultrasonic welding, hot welding, or vibration welding.

6. A developing device to be used in a main body of an electrophotographic image forming apparatus, said developing device comprising:

a developing member for developing an electrostatic latent image formed on an electrophotographic photosensitive member with developer;

a developing frame in which said developing member is disposed; and a developer container for containing the developer, said developer container including a container frame provided with an opening and a developer feeding opening for feeding the developer to said developing frame, and a lid frame connected to said container frame to close said opening of said container frame, wherein said container frame of said developer container has a lid frame connection portion to which said lid frame is connected at a peripheral portion of said opening, and a developing frame connection portion to which said developing frame is connected so that said container frame communicates with said developing frame through said developer feeding opening, and wherein said lid frame connection portion is located at least on one end side in a widthwise direction of said container frame, and said lid frame connection portion is located outside a plane perpendicular to said developing frame connection portion, said plane passing through an outer end portion in said widthwise direction of said developing frame connection portion being provided along a lengthwise direction of said developer feeding opening at an end in said widthwise direction of said developer feeding opening, and wherein a jig receiving portion is disposed inside said container frame, and said jig receiving portion receives a jig for supporting said developing frame connection portion when said developing frame connection portion is welded to said developing frame.

7. A developing device according to claim 6, wherein a removable seal member for closing said developer feeding opening is attached to said container frame by hot welding, and a surface of said container frame for receiving the seal member attached by the hot welding is arranged on substantially the same plane as a surface of said container frame for receiving said developing frame connected to said container frame.

8. A developing device according to claim 6 or 7, wherein said container frame is provided with a container flange formed integrally with said container frame, said container flange protruding outward from the peripheral portion of said opening, and said lid frame is provided with a lid flange formed integrally with said lid frame, said lid flange protruding outward from a peripheral portion of said lid frame, and said lid frame connection portion comprises said container flange and said lid flange.

9. A developing device according to claim 6 or 7, wherein said container frame and said lid frame are connected by a screw, an adhesive, ultrasonic welding, hot welding, or vibration welding.

10. A developing device according to claim 6 or 7, wherein said container frame and said developing frame are connected by ultrasonic welding, hot welding, or vibration welding.

11. A process cartridge detachably mountable to a main body of an electrophotographic image forming apparatus, said process cartridge comprising:

an electrophotographic photosensitive member;

a developing member for developing an electrostatic latent image formed on said electrophotographic photosensitive member with developer;

a developing frame in which said developing member is disposed; and a developer container for containing the developer, said developer container including a container frame provided with an opening and a developer feeding opening for feeding the developer to said developing frame, and a lid frame connected to said container frame to close said opening of said container frame, wherein said container frame of said developer container has a lid frame connection portion to which said lid frame is connected at a peripheral portion of said opening, and a developing frame connection portion to which said developing frame is connected so that said container frame communicates with said developing frame through said developer feeding opening, and wherein said lid frame connection portion is located at least on one end side in a widthwise direction of said container frame, and said lid frame connection portion is located outside a plane perpendicular to said developing frame connection portion, said plane passing through an outer end portion in said widthwise direction of said developing frame connection portion being provided along a lengthwise direction of said developer feeding opening at an end in said widthwise direction of said developer feeding opening, and wherein a jig receiving portion is disposed inside said container frame, and said jig receiving portion receives a jig for supporting said developing frame connection portion when said developing frame connection portion is welded to said developing frame.

12. A process cartridge according to claim 11, wherein a removable seal member for closing said developer feeding opening is attached to said container frame by hot welding, and a surface of said container frame for receiving the seal member attached by the hot welding is arranged on substantially the same plane as a surface of said container frame for receiving said developing frame connected to said container frame.

13. A process cartridge according to claim 11 or 12, wherein said container frame is provided with a container flange formed integrally with said container frame, said container flange protruding outward from the peripheral portion of said opening, and said lid frame is provided with a lid flange formed integrally with said lid frame, said lid flange protruding outward from a peripheral portion of said lid frame, and said lid frame connection portion comprises said container flange and said lid flange.

14. A process cartridge according to claim 11 or 12, wherein said container frame and said lid frame are connected by a screw, an adhesive, ultrasonic welding, hot welding, or vibration welding.

15. A process cartridge according to claim 11 or 12, wherein said container frame and said developing frame are connected by ultrasonic welding, hot welding, or vibration welding.

16. A process cartridge according to claim 11, wherein the lid frame connection portion is located on one end side in a widthwise direction of the container frame, and the lid frame connection portion is located outside a plane perpendicular to the developing frame connection portion, the plane passing through an outer end portion in the widthwise direction of the developing frame connection portion being provided along a lengthwise direction of the developer feeding opening at the other end in the widthwise direction of the developer feeding opening.

17. An electrophotographic image forming apparatus for forming an image on a recording medium, said electrophotographic image forming apparatus comprising:

(i) a mounting portion for detachably mounting a developing device, the developing device including:

a developing member for developing an electrostatic latent image formed on an electrophotographic photosensitive member with developer;

a developing frame in which the developing member is disposed; and a developer container for containing the developer, the developer container including a container frame provided with an opening and a developer feeding opening for feeding the developer to the developing frame, and a lid frame connected to the container frame to close the opening of the container frame, wherein the container frame of the developer container has a lid frame connection portion to which the lid frame is connected at a peripheral portion of the opening, and a developing frame connection portion to which the developing frame is connected so that the container frame communicates with the developing frame through the developer feeding opening, and wherein the lid frame connection portion is located at least on one end side in a widthwise direction of the container frame, and the lid frame connection portion is located outside a plane perpendicular to the developing frame connection portion, the plane passing through an outer end portion in the widthwise direction of the developing frame connection portion being provided along a lengthwise direction of the developer feeding opening at an end in the widthwise direction of the developer feeding opening, and wherein a jig receiving portion is disposed inside the container frame, and the jig receiving portion receives a jig for supporting the developing frame connection portion when the developing frame connection portion is welded to the developing frame; and (ii) a conveying member for conveying the recording medium.

18. An electrophotographic image forming apparatus to which a process cartridge is detachably mountable for forming an image on a recording medium, said electrophotographic image forming apparatus comprising:

(i) a mounting portion for detachably mounting a process cartridge, the process cartridge including:

an electrophotographic photosensitive member;

a developing member for developing an electrostatic latent image formed on the electrophotographic photosensitive member with developer;

a developing frame in which the developing member is disposed; and a developer container for containing the developer, the developer container including a container frame provided with an opening and a developer feeding opening for feeding the developer to the developing frame, and a lid frame connected to the container frame to close the opening of the container frame, wherein the container frame of the developer container has a lid frame connection portion to which the lid frame is connected at a peripheral portion of the opening, and a developing frame connection portion to which the developing frame is connected so that the container frame communicates with the developing frame through the developer feeding opening, and wherein the lid frame connection portion is located at least on one end side in a widthwise direction of the container frame, and the lid frame connection portion is located outside a plane perpendicular to the developing frame connection portion, the plane passing through an outer end portion in the widthwise direction of the developing frame connection portion being provided along a lengthwise direction of the developer feeding opening at an end in the widthwise direction of the developer feeding opening, and wherein a jig receiving portion is disposed inside the container frame, and the jig receiving portion receives a jig for supporting the developing frame connection portion when the developing frame connection portion is welded to the developing frame; and (ii) a conveying member for conveying the recording medium.

19. A method of assembling a developer container to be used in an electrophotographic image forming apparatus, said method comprising:

a developing frame connecting step of connecting a container frame to a developing frame by a developing frame connection portion so that the container frame communicates with the developing frame through a developer feeding opening, wherein the container frame is provided with an opening and the developer feeding opening for feeding the developer to the developing frame, in which a developing member is disposed, wherein the container frame has a lid frame connection portion to which a lid frame is connected at a peripheral portion of the opening, and the developing frame connection portion to which the developing frame is connected so that the container frame communicates with the developing frame through the developer feeding opening, and wherein a jig receiving portion is disposed inside the container frame, and the jig receiving portion receives a jig for supporting the developing frame connection portion when the developing frame connection portion is welded to the developing frame; and a lid frame connecting step of connecting the container frame to the lid frame by the lid frame connection portion so that the lid frame closes the opening, whereby the container frame and the lid frame are connected so that the lid frame connection portion is located at least on one end side in a widthwise direction of the container frame, and the lid frame connection portion is located outside a plane perpendicular to the developing frame connection portion, the plane passing through an outer end portion in the widthwise direction of the developing frame connection portion being provided along a lengthwise direction of the developer feeding opening at an end in the widthwise direction of the developer feeding opening.

20. A method of assembling a developer container according to claim 19, further comprising the step of:

attaching a removable seal member for closing the developer feeding opening to the container frame by hot welding before said developing frame connecting step.

21. A method of assembling a developer container according to claim 19, or 20, wherein said lid frame connecting step includes a step of connecting the lid frame to the container frame by a screw, an adhesive, ultrasonic welding, hot welding, or vibration welding.

22. A method of assembling a developer container according to claim 19 or 20, wherein said developing frame connecting step includes a step of connecting the developing frame to the container frame by ultrasonic welding, hot welding, or vibration welding.

23. A developer container to be used in a main body of an electrophotographic image forming apparatus, said developer container containing developer to be used for development of an electrostatic latent image formed on an electrophotographic photosensitive member by a developing member, said developer container comprising:

a container frame provided with an opening and a developer feeding opening for feeding the developer to a developing frame, in which the developing member is disposed; and a lid frame connected to said container frame to close said opening of said container frame, wherein said container frame has a lid frame connection portion to which said lid frame is connected at a peripheral portion of said opening, and a developing frame connection portion to which the developing frame is connected so that said container frame communicates with the developing frame through said developer feeding opening, and wherein said container frame further comprises a receiving surface configured to receive a jig when a removable seal member is welded to said container frame and configured to serve as a receiving surface for receiving the jig when said container frame is welded to the developing frame, said receiving surface being disposed inside said container frame.

24. A developer container according to claim 23, wherein the jig is insertable into said opening of said container frame, and wherein after the welding of said container frame and the developing frame, said opening of said container frame, through which the jig is inserted, is closed by said lid frame.

25. A developer container according to claim 23 or 24, wherein said container frame is provided with a container flange formed integrally with said container frame, said container flange protruding outward from the peripheral portion of said opening, and said lid frame is provided with a lid flange formed integrally with said lid frame, said lid flange protruding outward from a peripheral portion of said lid frame, and said lid frame connection portion comprises said container flange and said lid flange.

26. A developing device to be used in a main body of an electrophotographic image forming apparatus, said developing device comprising:

a developing member for developing an electrostatic latent image formed on an electrophotographic photosensitive member with developer;

a developing frame in which said developing member is disposed; and a developer container for containing the developer, said developer container including a container frame provided with an opening and a developer feeding opening for feeding the developer to said developing frame, and a lid frame connected to said container frame to close said opening of said container frame, wherein said container frame of said developer container has a lid frame connection portion to which said lid frame is connected at a peripheral portion of said opening, and a developing frame connection portion to which said developing frame is connected so that said container frame communicates with said developing frame through said developer feeding opening, and wherein said container frame further comprises a receiving surface configured to receive a jig when a removable seal member is welded to said container frame and configured to serve as a receiving surface for receiving the jig when said container frame is welded to the developing frame, said receiving surface being disposed inside said container frame.

27. A developing device according to claim 26, wherein the jig is insertable into said opening of said container frame, and wherein after the welding of said container frame and the developing frame, said opening of said container frame, through which the jig is inserted, is closed by said lid frame.

28. A developing device according to claim 26 or 27, wherein said container frame is provided with a container flange formed integrally with said container frame, said container flange protruding outward from the peripheral portion of said opening, and said lid frame is provided with a lid flange formed integrally with said lid frame, said lid flange protruding outward from a peripheral portion of said lid frame, and said lid frame connection portion comprises said container flange and said lid flange.

29. A process cartridge detachably mountable to a main body of an electrophotographic image forming apparatus, said process cartridge comprising:

an electrophotographic photosensitive member;

a developing member for developing an electrostatic latent image formed on said electrophotographic photosensitive member with developer;

a developing frame in which said developing member is disposed; and a developer container for containing the developer, said developer container including a container frame provided with an opening and a developer feeding opening for feeding the developer to said developing frame, and a lid frame connected to said container frame to close said opening of said container frame, wherein said container frame of said developer container has a lid frame connection portion to which said lid frame is connected at a peripheral portion of said opening, and a developing frame connection portion to which said developing frame is connected so that said container frame communicates with said developing frame through said developer feeding opening, and wherein said container frame further comprises a receiving surface configured to receive a jig when a removable seal member is welded to said container frame and configured to serve as a receiving surface for receiving the jig when said container frame is welded to the developing frame, said receiving surface being disposed inside said container frame.

30. A process cartridge according to claim 29, wherein the jig is insertable into said opening of said container frame, and wherein after the welding of said container frame and the developing frame, said opening of said container frame, through which the jig is inserted, is closed by said lid frame.

31. A process cartridge according to claim 29 or 30, wherein said container frame is provided with a container flange formed integrally with said container frame, said container flange protruding outward from the peripheral portion of said opening, and said lid frame is provided with a lid flange formed integrally with said lid frame, said lid flange protruding outward from a peripheral portion of said lid frame, and said lid frame connection portion comprises said container flange and said lid flange.

32. A method of assembling a developer container to be used in an electrophotographic image forming apparatus, said method comprising:

a first receiving step of receiving a jig by a receiving surface of a container frame when a removable seal member is to be welded to the container frame, the receiving surface being disposed inside the container frame;

a removable seal member welding step of welding the removable seal member to the container frame;

a second receiving step of receiving a jig by the receiving surface of the container frame when a developing frame is to be welded to the container frame, wherein the receiving surface in said first receiving step also serves as the receiving surface in said second receiving step;

a developing frame welding step of welding the container frame to the developing frame by a developing frame connection portion so that the container frame communicates with the developing frame through a developer feeding opening, wherein the container frame is provided with an opening through which the jig is inserted into the container frame and the developer feeding opening for feeding the developer to the developing frame in which a developing member is disposed, wherein the container frame has a lid frame connection portion to which a lid frame is connected at a peripheral portion of the opening, and the developing frame connection portion to which the developing frame is connected so that the container frame communicates with the developing frame through the developer feeding opening; and a lid frame connecting step of connecting the container frame to the lid frame by the lid frame connection portion so that the lid frame closes the opening.

* * * * *

UNITED STATES PATENT AND TRADEMARK OFFICE

CERTIFICATE OF CORRECTION

PATENT NO. : 6,684,040 B2
DATED : January 27, 2004
INVENTOR(S) : Akiyoshi Yokoi et al.

It is certified that error appears in the above-identified patent and that said Letters Patent is hereby corrected as shown below:

Title page,
Item [57], ABSTRACT,
Line 9, “developer, container” should read -- developer container, --.

Column 11,
Line 3, “Moreover;” should read -- Moreover, --.

Column 20,
Line 47, “frame” should read -- frame, --.

Signed and Sealed this

Twenty-ninth Day of June, 2004

JON W. DUDAS
*Acting Director of the United States Patent and Trademark Office*